US011779505B2

(12) United States Patent
Ishimine et al.

(10) Patent No.: US 11,779,505 B2
(45) Date of Patent: Oct. 10, 2023

(54) FINGER EXERCISER

(71) Applicants: Connect Inc., Tokyo (JP); Keio University, Tokyo (JP)

(72) Inventors: Tomoyasu Ishimine, Osaka (JP); Miho Hiramoto, Tokyo (JP); Kohei Okuyama, Tokyo (JP)

(73) Assignees: Keio University, Tokyo (JP); LIFESCAPES Inc., Tokyo (JP)

( * ) Notice: Subject to any disclaimer, the term of this patent is extended or adjusted under 35 U.S.C. 154(b) by 731 days.

(21) Appl. No.: 16/756,816

(22) PCT Filed: Oct. 19, 2018

(86) PCT No.: PCT/JP2018/038934
§ 371 (c)(1),
(2) Date: Apr. 16, 2020

(87) PCT Pub. No.: WO2019/078329
PCT Pub. Date: Apr. 25, 2019

(65) Prior Publication Data

US 2021/0369535 A1 Dec. 2, 2021

(30) Foreign Application Priority Data

Oct. 20, 2017 (JP) ..... 2017-204095

(51) Int. Cl.
*A61H 1/02* (2006.01)

(52) U.S. Cl.
CPC ..... *A61H 1/0288* (2013.01); *A61H 1/02* (2013.01); *A61H 2201/0153* (2013.01);
(Continued)

(58) Field of Classification Search
CPC ..... A61H 1/0288; A61H 2201/1215; A61H 2201/1638; A61H 2201/5007;
(Continued)

(56) References Cited

U.S. PATENT DOCUMENTS 3,631,542 A 1/1972 Potter
2014/0277582 A1 9/2014 Leuthardt

FOREIGN PATENT DOCUMENTS

CN 106994086 A 8/2017
JP 2004-298355 A 10/2004
(Continued)

OTHER PUBLICATIONS

Takeshita, T. Joint Fixing Device (Oct. 2004) Machine Translation of JP2004298355A, Espacenet. https://worldwide.espacenet.com/patent/search/family/033406841/publication/JP2004298355A?q=JP%202004298355%20A. Accessed on Dec. 14, 2022. (2022) (Year: 2022).*

(Continued)

*Primary Examiner* — Joseph D. Boecker
*Assistant Examiner* — Maap Ahmed Ellabib
(74) *Attorney, Agent, or Firm* — Renner, Otto, Boisselle & Sklar, LLP

(57) ABSTRACT

A finger exerciser includes: a frame on which a palm of a subject to be put; a movable section; a first fixing element; and a second fixing element. The movable is configured to move a first finger group of a subject. The first fixing element is configured to fix a position of the first finger group to the movable section. The second fixing element is configured to fix a position of a second finger group to the frame and has a band-like member including at least two attachment parts apart from each other in a longitudinal direction of the band-like member. The band-like member is attached to the frame at the attachment parts and includes a holder whose location to the frame is changeable. The band-like member is configured to hold the second finger group in a state where the band-like member is attached to the frame.

5 Claims, 12 Drawing Sheets

(52) U.S. Cl.
CPC .. *A61H 2201/0157* (2013.01); *A61H 2201/12* (2013.01); *A61H 2201/1215* (2013.01); *A61H 2201/1223* (2013.01); *A61H 2201/165* (2013.01); *A61H 2201/1638* (2013.01); *A61H 2201/1671* (2013.01); *A61H 2201/5007* (2013.01); *A61H 2205/067* (2013.01); *A61H 2230/10* (2013.01)

(58) Field of Classification Search
CPC ..... A61H 2230/10; A61H 2201/0153; A61H 2201/0157; A61H 2201/12; A61H 2201/1223; A61H 2201/165; A61H 2201/1671; A61H 2205/067; A61H 1/02
See application file for complete search history.

(56) References Cited

FOREIGN PATENT DOCUMENTS

| | | | |
|---|---|---|---|
| JP | 2013-017718 | A | 1/2013 |
| WO | 2017/110453 | A1 | 6/2017 |

OTHER PUBLICATIONS

International Search Report and Written Opinion for corresponding Application No. PCT/JP2018/038934, dated Jan. 8, 2019.
Extended European Search Report for corresponding Application No. 18869239.6, dated Nov. 25, 2020.

* cited by examiner

FINGER EXERCISER

TECHNICAL FIELD

The present disclosure generally relates to finger exercisers, and specifically, to a finger exerciser for moving a subject's fingers.

BACKGROUND ART

Patent Literature 1 discloses a rehabilitation device which is worn by a subject on his or her hand and arm for rehabilitation to recover the function of the subject's fingers. The rehabilitation device described in Patent Literature 1 includes a metacarpal region fixing part for fixing the palm of a user, a proximal phalange region fixing part for fixing proximal phalange regions of fingers except for the thumb of the user with a fixing band, and a middle phalange region fixing part for fixing middle phalange regions of the fingers with a fixing band. The rehabilitation device further includes, as a drive source of these parts, a first servomotor for rotating the proximal phalange region fixing part with respect to the metacarpal region fixing part, and a second servomotor for rotating the middle phalange fixing part with respect to the proximal phalange region fixing part.

The rehabilitation device described in Patent Literature 1 is configured to move fingers by power from the first servomotor and the second servomotor to enable rehabilitation for a user.

In the rehabilitation device described in Patent Literature 1, however, a first finger group (second to fifth fingers) which is to be driven is fixed with the fixing band, but a second finger group (first finger) is not held, and the position of the second finger group may thus not be fixed. For this reason, for rehabilitation, even if, for example, a subject tries to perform an action of gripping an object with the first finger group and the second finger group, it may not be possible to execute the action properly.

CITATION LIST

Patent Literature

Patent Literature 1: JP 2013-17718 A.

SUMMARY OF INVENTION

In view of the foregoing background, it is therefore an object of the present disclosure to provide a finger exerciser configured to adjust a positional relationship between a first finger group and a second finger group to an appropriate positional relationship.

A finger exerciser of a first aspect includes: a frame; a movable section; a first fixing element; and a second fixing element. On the frame, a palm of a subject is to be put. The movable section is configured to move a first finger group including at least one finger of the subject. The first fixing element is configured to fix a relative position of the first finger group to the movable section. The second fixing element is configured to fix a relative position of a second finger group to the frame. The second finger group includes at least one finger of fingers different form the first finger group. The second fixing element includes a band-like member having at least two attachment parts apart from each other in a longitudinal direction of the band-like member. The band-like member is configured to be attached to the frame at the at least two attachment parts. The band-like member includes a holder whose relative position to the frame is changeable. The band-like member is configured to hold the second finger group by the holder in a state where the band-like member is attached to the frame.

DESCRIPTION OF EMBODIMENTS

First Embodiment (1) Schema

Figure 1:
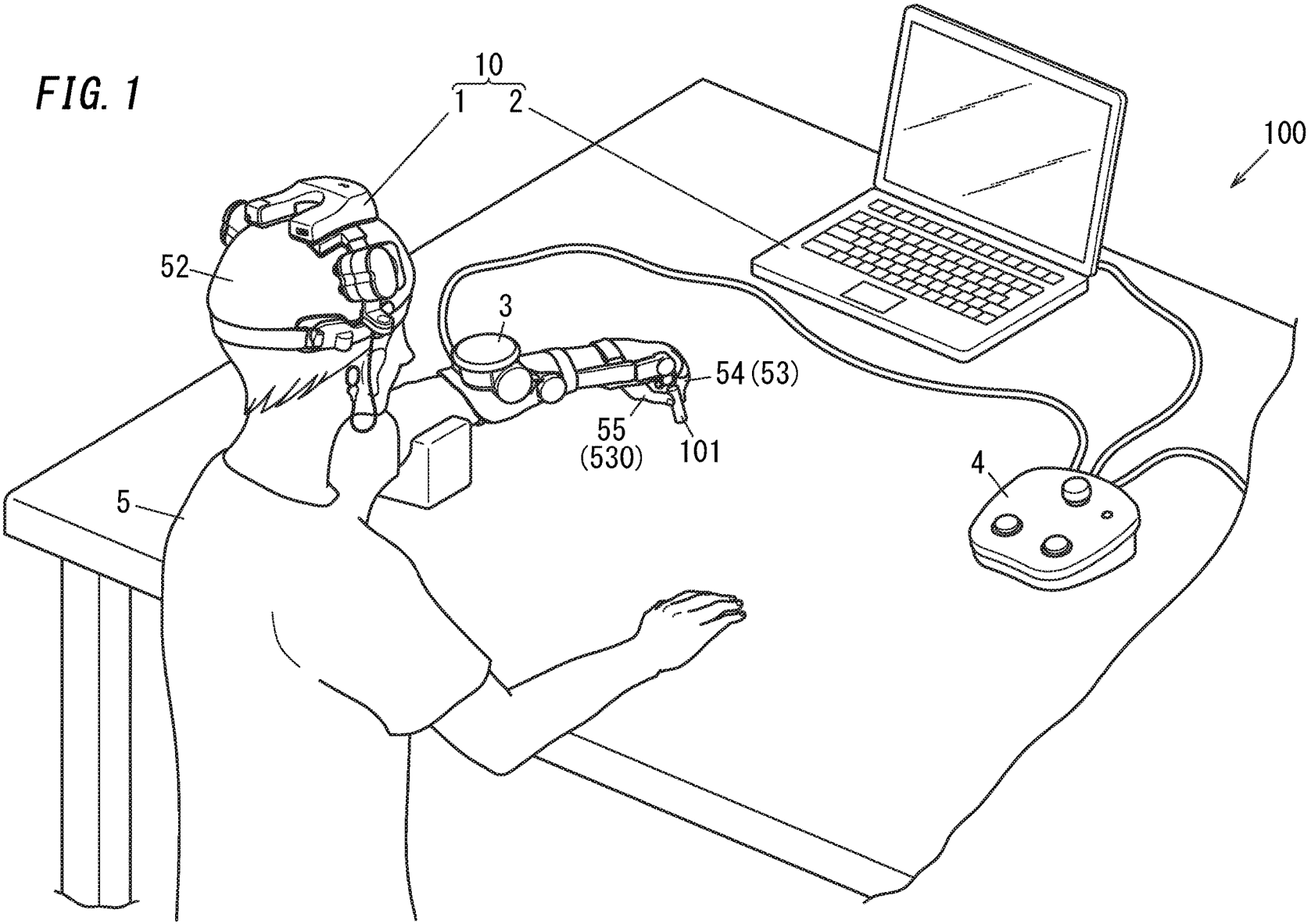
FIG. 1 is a schematic diagram showing a finger exerciser according to a first embodiment and a usage state of a rehabilitation support system including the finger exerciser.

In describing a finger exerciser 6 according to the present embodiment, a schema of a rehabilitation support system 100 including the finger exerciser 6 will be described at first with reference to FIGS. 1-3.

This rehabilitation support system 100 according to this embodiment supports a subject 5, who suffers from either a motor paralysis or a decline in motor function in some region of his or her body due to some brain disease such as cerebral apoplexy (stroke) or an accident, in his or her rehabilitation by exercise therapy. Such a subject 5 may either be unable to do, or show a decline in the physical ability to do well, a voluntary movement, which is a movement that the subject 5 does of his or her own will or by intention. As used herein, the "exercise therapy" refers to a method for recovering a voluntary movement function for an affected region of the subject's 5 body by making the subject 5 exercise his or her region that is either unable to do, or shows a decline in the physical ability do well, such a voluntary movement (hereinafter referred to as "affected region").

In the following description of embodiments, the rehabilitation support system 100 is supposed to be used, for example, to support the subject 5 in his or her rehabilitation to recover the function of his or her left hand fingers 53. That is to say, in this case, the subject's 5 left hand fingers are his or her affected region. However, this is only an example and should not be construed as limiting. Alternatively, the rehabilitation support system 100 may also be used to support the subject 5 in his or her rehabilitation to recover the function of his or her right hand fingers.

The rehabilitation support system 100 supports the subject 5 in his or her voluntary movement by having an exercise assisting device 3, which the subject 5 wears on his or her left hand, apply at least one of a mechanical stimulus or an electrical stimulus to his or her left hand when the subject 5 plans to do the voluntary movement using his or her left hand fingers 53. This allows, just like a situation where a medical staff such as a physical therapist or an occupational therapist supports the subject 5 in his or her voluntary movement by holding the subject's 5 fingers 53, the rehabilitation support system 100 to support him or her in the voluntary movement. Thus, the rehabilitation support system 100 is able to provide rehabilitation by exercise therapy more effectively than in a situation where the subject 5 does the voluntary movement by him- or herself, to say nothing of a situation where some medical staff provides the support.

The rehabilitation support system 100 according to this embodiment includes an electroencephalogram measurement system 10, the exercise assisting device 3, and a controller 4.

The electroencephalogram measurement system 10 is a system for measuring an electroencephalogram specific to a subject 5, and acquires electroencephalogram information representing a subject-specific electroencephalogram obtained by an electrode unit 11 placed on a region of interest 51 that forms part of the subject's 5 head 52. As used herein, the "electroencephalogram (EEG)" refers to a waveform recorded by deriving, out of a human's body, electrical signals (action potentials) generated by (groups of) nerve cells (or neurons) of a human brain. Also, as used herein, an "electroencephalogram" refers to, unless otherwise stated, an on-scalp electroencephalogram obtained by recording, using the electrode unit 11 worn by the subject 5 on his or her body surface, a comprehensive action potential of a great many groups of neurons (that form a neural network) of the cerebral cortex.

The electroencephalogram measurement system 10 includes a headset 1 with the electrode unit 11 and an information processor 2. The headset 1 is worn by a subject 5 on his or her head 52 with the electrode unit 11 brought into contact with his or her head 52 surface (i.e., scalp) as shown in FIG. 2. According to the present disclosure, the electrode unit 11 is mounted on paste (electrode paste) applied onto the surface of the head 52, and thereby comes into contact with the surface of the head 52. In this case, the electrode unit 11 comes into direct contact with (i.e., not via the subject's hairs) the surface of the head 52 by pushing the hairs aside. Naturally, the electrode unit 11 may come into direct contact with the surface of the head 52 with no paste applied between them. That is to say, according to the present disclosure, "to bring the electrode unit 11 into contact with the surface of the head 52" refers to not only bringing the electrode unit 11 into direct contact with the surface of the head 52 but also bringing the electrode unit 11 into indirect contact with the surface of the head 52 with some intermediate interposed between the electrode unit 11 and the surface of the head 52. The intermediate does not have to be paste but may also be a gel with electrical conductivity.

The headset 1 measures the electroencephalogram specific to the subject 5 by having the electrode unit 11 measure the action potential of the subject's 5 brain, thereby generating electroencephalogram information representing the electroencephalogram. The headset 1 may transmit the electroencephalogram information to the information processor 2 by wireless communication, for example. In response, the information processor 2 subjects the electroencephalogram information acquired from the headset 1 to various types of processing, or displays the electroencephalogram information thereon.

The controller 4 controls the exercise assisting device 3 in accordance with the electroencephalogram information acquired by the electroencephalogram measurement system 10.

The exercise assisting device 3 is a device for assisting the subject 5 with his or her exercise by applying at least one of a mechanical stimulus or an electrical stimulus to the subject 5. Specifically, the exercise assisting device 3 includes the finger exerciser 6 and an electrical stimulus generator 32 as shown in FIG. 3.

Figure 4:
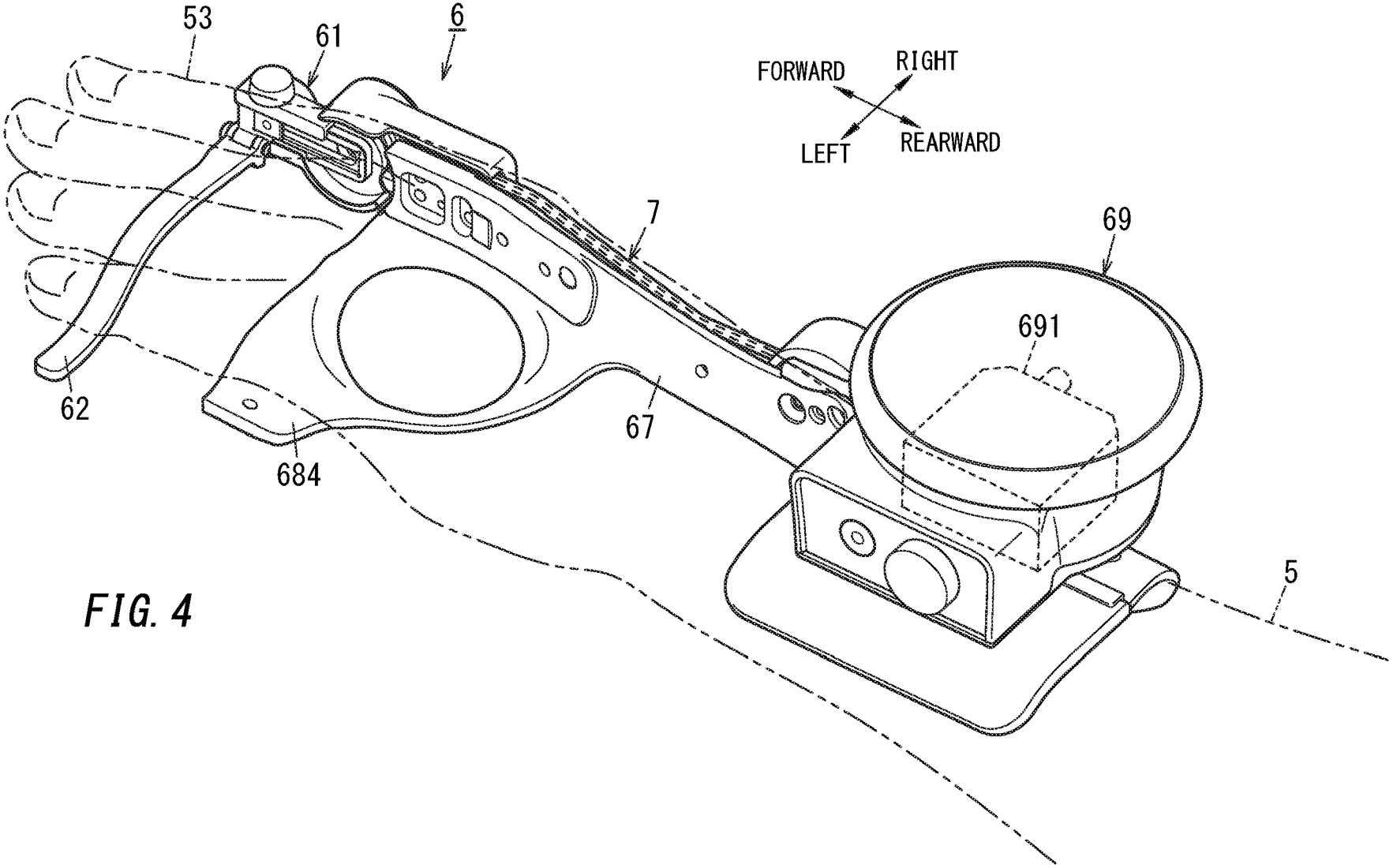
FIG. 4 is a perspective view of the finger exerciser.

The finger exerciser 6 is a device for moving four fingers 53 (namely, the second finger 531 as the index finger, the third finger 532 as the middle finger, the fourth finger 534 as the ring finger, and the fifth finger 534 as the pinky finger), except the first hand finger 530 (thumb), by holding the four fingers 53 and applying a mechanical stimulus (external force) to these four fingers 53. As shown in FIG. 4, the finger exerciser 6 includes a frame 67, a driver 69, a transmission mechanism 7, and a movable section 61. The finger exerciser 6 will be described in detail in "(2.1) Finger Exerciser".

The electrical stimulus generator 32 is a device for applying an electrical stimulus to the subject's 5 region for moving his or her fingers 53. In this case, the subject's 5 region for moving his or her fingers 53 includes a region corresponding to at least one of a muscle or a nerve of the subject's 5 fingers 53. The electrical stimulus generator 32 includes a pad to be attached to the subject's 5 body (such as his or her right or left arm). The electrical stimulus generator 32 applies a stimulus to the region for moving the fingers 53 by applying an electrical stimulus (in the form of an electrical current) from the pad to the subject's 5 body.

Meanwhile, to provide support for such rehabilitation, the rehabilitation support system 100 suitably assists, using the exercise assisting device 3, the subject 5 with his or her voluntary movement when the subject 5 plans to do the voluntary movement on his or her own. The rehabilitation support system 100 assists, when the subject 5 plans to do voluntary movement, him or her in the voluntary movement using the exercise assisting device 3 by operating the exercise assisting device 3 in coordination with the subject's 5 electroencephalogram (electroencephalogram information) measured and recorded by the electroencephalogram measurement system 10. In other words, the rehabilitation support system 100 provides rehabilitation by exercise therapy by using the brain-machine interface (BMI) technology for operating a machine (such as the exercise assisting device 3) based on the brain activity (electroencephalogram).

When the subject 5 is going to do voluntary movement (i.e., while the subject 5 is doing the voluntary movement), a characteristic variation may arise in his or her electroencephalogram. That is to say, when the subject 5 plans to do (or imagines doing) the voluntary movement, a brain region corresponding to the region that should be exercised to do the voluntary movement may be activated. Examples of such brain regions include a somatosensory motor cortex.

Supporting the subject 5 in his or her voluntary movement using the exercise assisting device 3 at the timing when the brain region is activated would make the rehabilitation even more effective. Such brain region activation may be detected as a characteristic variation in electroencephalogram. Thus, the rehabilitation support system 100 starts supporting the subject 5 in his or her voluntary movement using the exercise assisting device 3 at the timing when this characteristic variation arises in the electroencephalogram specific to the subject 5. Note that such a characteristic variation may arise in the electroencephalogram even if the voluntary movement is not actually carried out but when the subject 5 imagines doing the voluntary movement (i.e., plans to do the movement). That is to say, this characteristic variation may arise in the electroencephalogram even if the voluntary movement is not actually carried out but when the subject 5 plans to do, or imagines doing, the voluntary movement to activate the corresponding brain region. Therefore, the rehabilitation support system 100 may also support even a subject 5, who is unable to do the voluntary movement, in his or her attempt to do the voluntary movement.

The rehabilitation support system 100 with such a configuration is able to provide effective rehabilitation by exercise therapy for the subject 5 while lightening the workload on medical staff. In addition, this rehabilitation support system 100 eliminates the variation in timing to start supporting the subject 5 in his or her voluntary movement due to a human factor such as the skill level of the medical staff who needs to support the subject 5 in his or her voluntary movement, thus reducing the variation in the effect of rehabilitation. In particular, the rehabilitation support system 100 is able to start supporting the subject 5 in his or her voluntary movement at the timing when a characteristic variation arises in his or her specific electroencephalogram (i.e., the timing when the brain region is actually activated). As can be seen, this rehabilitation support system 100 allows the subject 5 to start training at the timing when his or her brain activity starts, thus contributing to learning and establishing right brain activity. Among other things, it is difficult for even the subject 5 him- or herself and the medical staff to determine whether or not such a characteristic variation has arisen in his or her electroencephalogram. Thus, using this rehabilitation support system 100 provides highly effective rehabilitation that is usually difficult to realize by either the subject 5 or the medical staff alone.

In the embodiment to be described below, when the subject 5 uses the rehabilitation support system 100, the subject 5 is supposed to be accompanied by some medical staff such as a physical therapist or an occupational therapist and the rehabilitation support system 100 is supposed to be operated by the medical staff. However, the subject 5 who uses the rehabilitation support system 100 does not have to be accompanied by medical staff. Alternatively, the rehabilitation support system 100 may be operated by either the subject 5 him-or herself or his or her family member as well.

In the following description of this embodiment, the rehabilitation support system 100 is supposed to be used, for example, to support the subject 5 in his or her rehabilitation to recover the function of gripping something with his or her left hand fingers. As used herein, the "gripping action" refers to the action of gripping something. That is to say, in the case of this subject 5, his or her left hand fingers are the affected region, and the rehabilitation support system 100 is used to support the subject 5 in his or her rehabilitation to recover the ability to do voluntary movement, namely, the ability to grip something with his or her left hand fingers. Actually, however, the rehabilitation support system 100 does not directly support the subject 5 in his or her gripping action but indirectly supports him or her in the attempt (rehabilitation) to recover the ability to grip something by assisting the subject 5 with his or her action of stretching fingers. As used herein, the "stretching action" refers to the action of opening a hand by stretching four fingers 53 (namely, second to fifth fingers 531-534), except the first finger 530 (i.e., the thumb), or the action of releasing an "object" that the subject 5 is gripping through the gripping action.

Thus, according to this embodiment, the subject 5, who is doing the stretching action as the voluntary movement, in his or her voluntary movement (stretching action) is supported by making the exercise assisting device 3 worn by the subject 5 on his or her left hand apply either or both of a mechanical stimulus and/or an electrical stimulus to the subject's 5 left hand fingers 53. In the following description of this embodiment, it will be described how the rehabilitation support system 100 supports the subject 5 in his or her voluntary movement (i.e., the stretching action) to be done by the subject 5 in order to release a peg 101 (see FIG. 1) from his or her left hand by stretching the fingers 53 from a position where he or she is gripping the peg 101 with his or her left hand fingers.

Here, a relative positional relationship of the second to fifth fingers 531-534 with respect to the first finger 530 is preferably in an appropriate positional relationship in order for the subject 5 to correctly grip an object such as the peg 101 through the gripping action. This is because when in the present embodiment, the subject 5 performs the gripping action, the second to fifth fingers 531-534 are moved by the finger exerciser 6, but if the first finger 530 is not in an appropriate position with respect to the second to fifth fingers 531-534, the subject 5 cannot grip the object such as the peg 101. In particular, some subjects 5 may have first fingers 530 which are abducted or adducted depending on the state of paralysis, and it is difficult to keep the first fingers 530 in the appropriate position relative to the second to fifth fingers 531-534 by the intention of the subjects 5.

Figure 8:
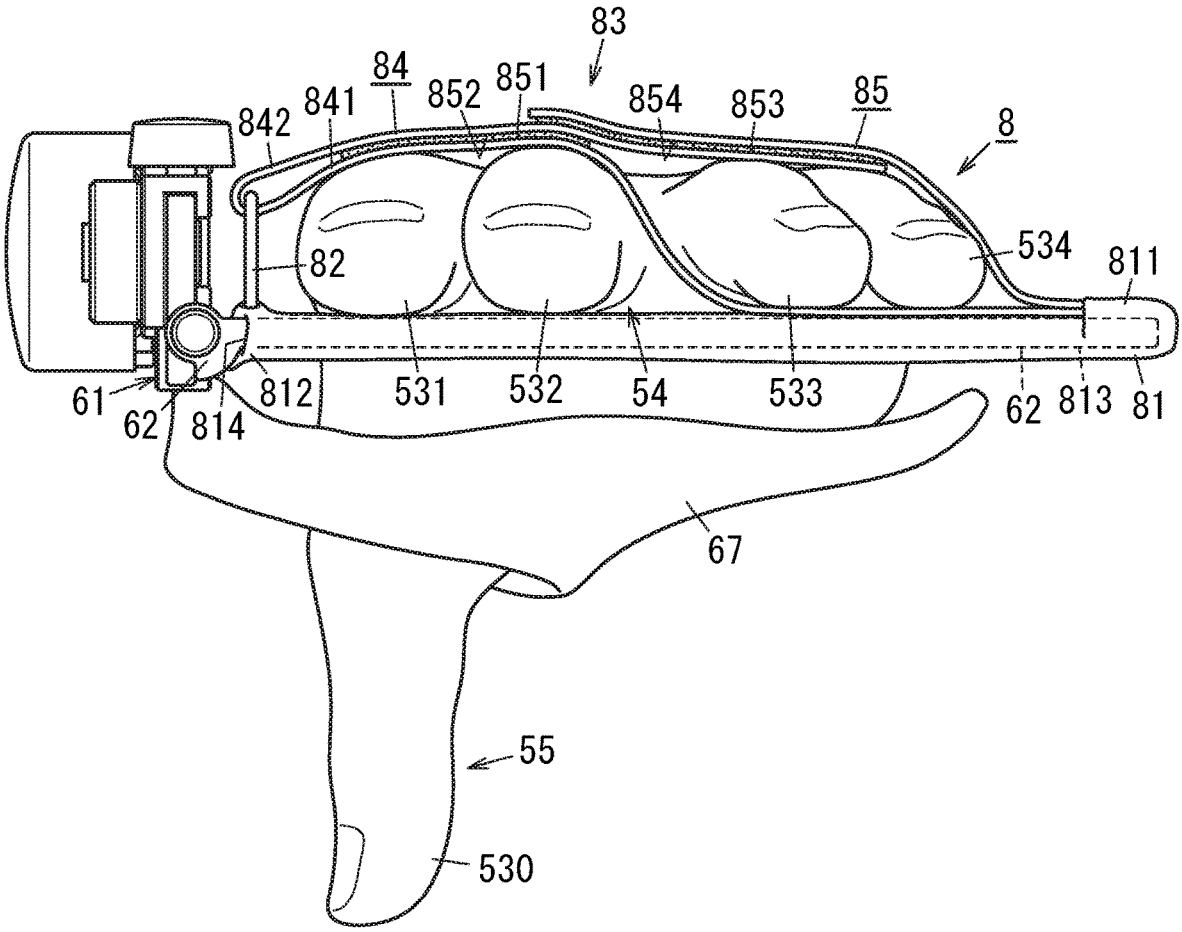
FIG. 8 is a front view of a state where the finger exerciser is worn by a subject on his or her left hand fingers.

Therefore, in the present embodiment, the finger exerciser 6 fixes a relative position of the second to fifth fingers 531-534 to the movable section 61 by using a first fixing element 8 (see FIG. 8). Moreover, in the finger exerciser 6, a second fixing element 9 is used to fix a relative position of the first finger 530 to the frame 67 (see FIGS. 10A-10C and FIGS. 11A-11C). The second fixing element 9 includes a band-like member 90 that is attached to the frame 67 at least at two attachment parts. The band-like member 90 has a holder 93 whose location relative to the frame 67 is changeable. This enables the position of the first finger 530 to be adjusted to an appropriate positional relationship with respect to the second to fifth fingers 531-534.

In the present disclosure, the appropriate positional relationship of the first finger 530 to the other fingers 53 for gripping an object is referred to as an "opposing position". In the present embodiment, the positional relationship of the first finger 530 to the second to fifth fingers 531-534 will be described as an example, but depending on objects to be gripped, the appropriate positional relationship for a positional relationship of, for example, the first hand finger 530 to only the second finger 531 may be referred to as the "opposing position".

As used herein, the "first finger 530 is abducted" means that the first finger moves in a direction away from the third hand finger in a direction in which the plurality of fingers align when a "gripping" action (i.e., gripping action) is going to be done, and an appropriate gripping action thus cannot be done. In the present embodiment, the second to fifth hand fingers 531-534 move relative to the first finger 530 held by the frame 67, but the relative abduction of the first finger 530 when the gripping action is going to be done is also referred to as "the first finger 530 is abducted". As used herein, the "first finger 530 is adducted" means that the first finger 530 moves in a direction toward the third finger 532 in the direction in which the plurality of hand fingers align when the gripping action is going to be done, and an appropriate gripping action thus cannot be made. The relative adduction of the first finger 530 when the gripping action is going to be done is also referred to as "the first finger 530 is adducted".

(2) Details (2.1) Finger Exerciser

The finger exerciser 6 according to the present embodiment will be described below in more detail. In the following description, reference is made to a state where the finger exerciser 6 is worn by a subject 5 in a position in which the subject 5 horizontally extends his or her left forearm and turns his or her left palm downward. In particular, a direction from the driver 69 toward a finger rest 62 is defined as a "forward direction" (forward), a direction opposite to the forward direction is defined as a "rearward direction" (rearward), and a direction parallel to the forward direction and the rearward direction is sometimes referred to as a forward and rearward direction. A direction which is orthogonal to the forward direction and the rearward direction and which extends along a horizontal plane (the direction in which the fingers 53 align) is defined as "left and right directions". Of the left and right directions, a direction from the second finger toward the fifth finger is defined as a "left direction", and a direction opposite to the left direction is defined as a "right direction".

An outer surface cover is attached to the finger exerciser 6 according to the present embodiment but is omitted in the drawings. The outer surface cover is made of, for example, cloth, nylon, or the like. Accordingly, as used herein, saying that the finger exerciser 6 comes into "contact" with the fingers 53 or the forearm includes that the finger exerciser 6 directly touches the fingers 53 or the forearm; and in addition, that the finger exerciser 6 touches the fingers 53 or the forearm via an intermediate such as a cover.

The finger exerciser 6 is a device configured to move at least one finger 53 of a subject 5 by applying a mechanical stimulus (external force) to the at least one finger 53. In the present embodiment, the at least one finger 53 to which the mechanical stimulus is applied includes four fingers 53 (second to fifth fingers 531-534) except for the first finger 530 (thumb).

The finger exerciser 6 according to this embodiment is able to do two types of operations, namely, an "opening operation" of moving the four fingers 53 away from the first finger 530 (i.e., stretching the four fingers 53) and a "closing operation" of moving the four fingers 53 toward the first finger 530 (i.e., making the fingers 53 grip something) by applying a mechanical stimulus thereto. The finger exerciser's 6 opening operation assists the subject 5 with his or her fingers 53 stretching action, and the finger exerciser's 6 closing operation assists the subject 5 with his or her fingers 53 gripping action.

As used herein, the "gripping action" refers to the action of gripping something. As used herein, the "stretching action" refers to the action of opening a hand by stretching four fingers 53 (namely, second to fifth fingers 531-534), except the first finger 530 (i.e., the thumb), or the action of releasing an "object" that the subject 5 is gripping through the gripping action. Actually, however, the rehabilitation support system 100 does not directly support the subject 5 in his or her gripping action but indirectly supports him or her in his or her gripping action by assisting the subject 5 with his or her action of stretching fingers 53.

Figure 5:
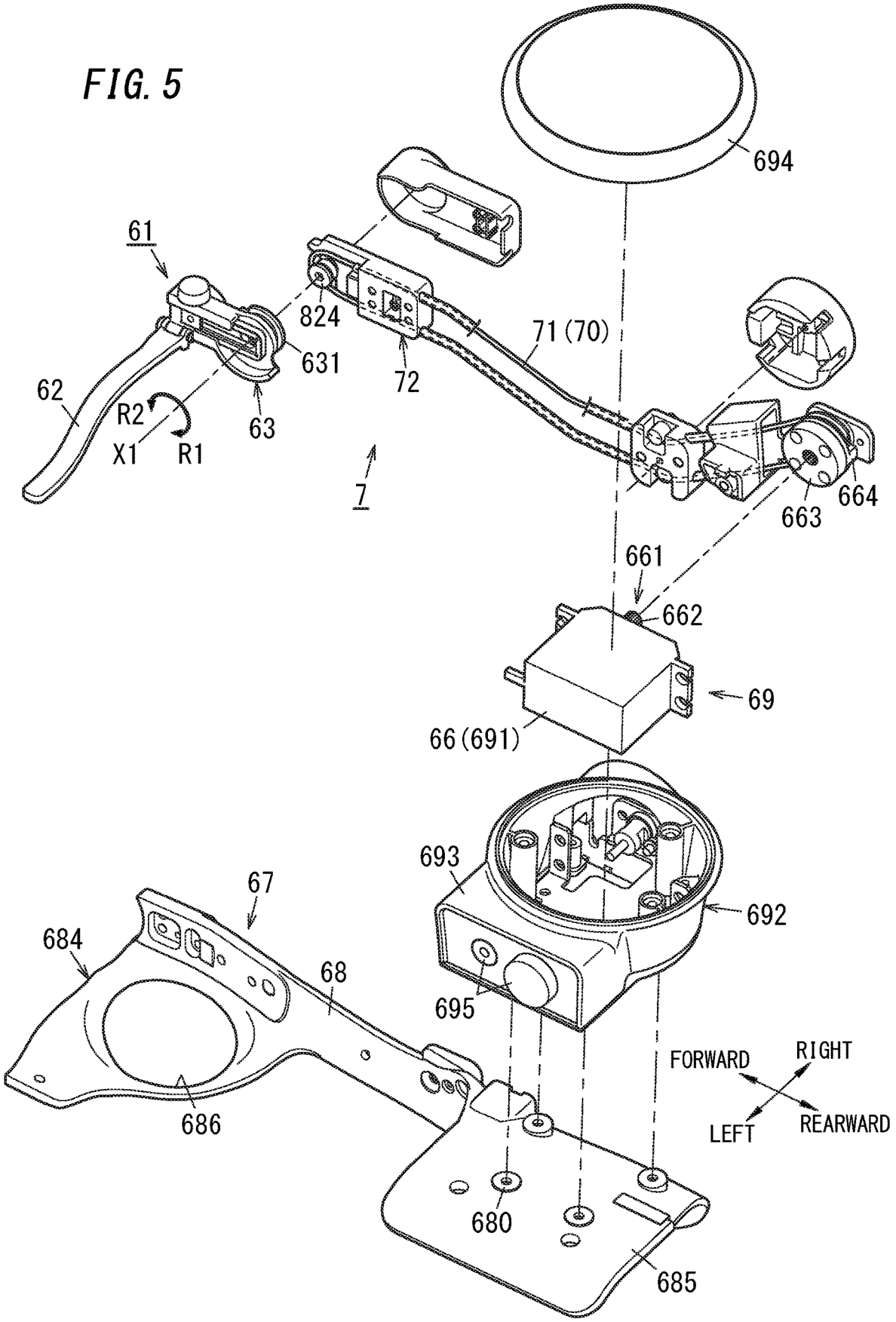
FIG. 5 is an exploded perspective view of the finger exerciser.

As shown in FIG. 5, the finger exerciser 6 includes the frame 67, the driver 69, the transmission mechanism 7, and the movable section 61. The movable section 61 includes the finger rest 62.

The frame 67 keeps a position of at least one of the five fingers other than the fingers which are moved by the movable section 61. In the present embodiment, the frame 67 keeps the location of a thenar region, thereby keeping the position of the first finger 530 (thumb) at a prescribed position. The frame 67 extends along the arm of the subject 5 and has a first projection 684 which is a front end and on which the palm of the subject 5 is to be put. The frame 67 includes a base 68, the first projection 684, and a second projection 685. The frame 67 is a molded piece made of a synthetic resin, and the base 68, the first projection 684, and the second projection 685 are integrally formed. As used herein, "palm" refers to the anterior surface of the hand between the wrist and fingers.

Figure 6:
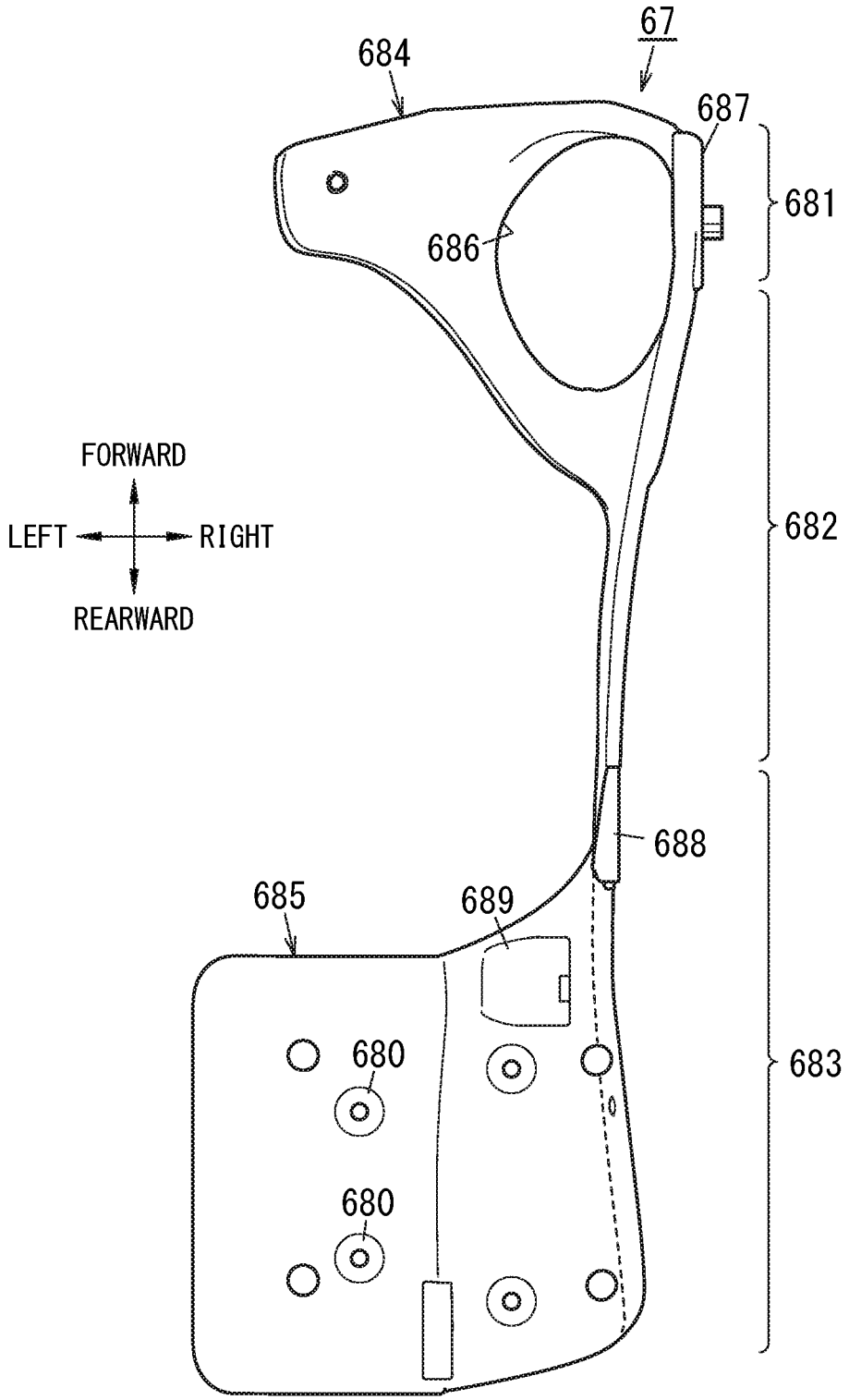
FIG. 6 is a plan view of a frame of the finger exerciser.

The base 68 constitutes a main body of the frame 67. The base 68 extends in the forward and rearward direction, has a forward end in proximity to the movable section 61 and a rearward end in proximity to the driver 69. In other words, the base 68 extends from the movable section 61 towards a drive source 691. The base 68 has a longitudinal direction in a direction along the forward and rearward direction, a width in the upward and downward direction (height direction), and a thickness in the left and right directions. As shown in FIG. 6, the base 68 includes a first region 681, a second region 682, and a third region 683. The first region 681, the second region 682, and the third region 683 are arranged in this order from the front to the rear and are integrally formed.

The first region 681 is a portion along an MP joint (the joint at the base of the index finger). The first region 681 extends parallel to the forward and rearward direction. The first region 681 has a width substantially corresponding to the average thickness of the MP joint from the general population. The first region 681 has an attachment 687. The attachment 687 is a portion to which a movable section attachment 72 described later is attached.

The second region 682 is a portion which is to lie along the root of the first finger 530 (thumb) at the back of the hand. The second region 682 is tilted leftward as viewed from above (in plan view) as the second region 682 goes to the back. The width of the second region 682 is equal to the width of the first region 681. The second region 682 comes into contact with the root of the first finger 530 (thumb) in a position in which the finger tip of the first finger 530 faces downward.

The third region 683 is a portion which is to lie along a forward end of a radial bone. The third region 683 extends parallel to the forward and rearward direction. The third region 683 comes into contact with a right side surface of a forward end of the forearm.

Thus, the base 68 is curved at an intermediate portion in the longitudinal direction in plan view so as to lie along side surfaces (right side surfaces) of the hand and the forearm from the MP joint through the radial bone of a subject 5. The base 68 having such a configuration has a front part provided with a first projection 684 and a rear part provided with a second projection 685.

The first projection 684 is a portion which is to hold the thenar region and on which the palm is to be put. The first projection 684 projects either in the right or left direction (here in the left direction) at a lower end of the base 68 and forms the front part of the base 68. The first projection 684 has a tip end (end in the left direction) in a protrusion direction, and the tip end protrudes to a location where the tip end corresponds to the root of the little finger.

As used herein, "front part of the base 68" refers to all or part of a forward region in the longitudinal direction from the center of the base 68. Thus, the first projection 684 in the present embodiment protrudes in the left direction from a portion including the forward end of the base 68, but the first projection 684 may protrude from a portion except for the forward end if the portion is within the forward region in the longitudinal direction from the center of the base 68.

The first projection 684 has an opening section 686 which allows the first finger 530 (thumb) to passes through. The opening section 686 has an ellipse shape in plan view and penetrates through the first projection 684 in the upward and downward direction. The opening section 686 has an outer peripheral edge which is recessed downward and which is configured to, when the first finger 530 is put through the opening section 686, come into planar contact with the root of first finger 530 along the periphery of the root.

The second projection 685 is a portion to which a driver 69 to be described later is attached. The second projection 685 protrudes at an upper end of the base 68 and from the rear part of the base 68 in a direction the same as the direction in which the first projection 684 protrudes. The second projection 685 is configured to come into contact with an upper surface of the forearm.

As used herein, "rear part of base 68" refers to all or part of a rearward region in the longitudinal direction from the center of the base 68. Thus, the second projection 685 in the present embodiment protrudes in the left direction from a portion including a rearward end of the base 68. However, the second projection 685 may protrude from a portion except for the rearward end if the portion is within the rearward region in the longitudinal direction from the center of the base 68.

The second projection 685 has a plurality of screw holes 680, and as illustrated in FIG. 5, the driver 69 is screwed to the plurality of screw holes 680.

The driver 69 is an apparatus in which the drive source 691 is accommodated. The driver 69 includes the drive source 691 and a case 692. The drive source 691 is accommodated in the case 692. The case 692 includes a box 693 having an opening opened upward and a lid 694 for closing the opening. The box 693 is provided with connectors 695 for supplying power to the drive source 691. Cables connected to the controller 4 are connected to the connectors 695.

The drive source 691 generates power. In the present embodiment, the drive source 691 includes, for example, a motor 66 such as a servomotor or a stepper motor, or a solenoid. In the present embodiment, the drive source 691 is a motor 66 (servomotor). For this reason, the drive source 691 will hereinafter be described as the motor 66.

The motor 66 is supplied with electric power to rotate its output shaft. A coupler 661 is attached to the output shaft. The coupler 661 includes: a pinion gear 662 directly fixed to the output shaft of the motor 66; an internal gear 663 which engages with the pinion gear 662; and a first pulley 664 fixed to the internal gear 663. The first pulley 664 and the internal gear 663 are concentrically fixed and rotate at the same angular velocity. The first pulley 664 is rotatably attached to the case 692. A linear member 70 is connected to the first pulley 664.

The linear member 70 is a member configured to transmit power generated by the motor 66 (the drive source 691) to the movable section 61. The linear member 70 is an elongated member that moves in its longitudinal direction with power generated by the motor 66. The linear member 70 may be a wire made of metal, a belt made of rubber or leather, a string, or the like. In the present embodiment, the linear member 70 is a wire 71. Thus, the linear member 70 will hereinafter be described as the wire 71. The linear member 70 is made of a flexible material and is thus flexible. The wire 71 extends between the first pulley 664 and a second pulley 631.

In the present embodiment, the linear member 70 has an annular shape, and rotation of the first pulley 664 accordingly rotates the linear member 70. The linear member 70 does not move in terms of its installation place but moves in a prescribed pathway along a direction along the annular shape (i.e., longitudinal direction).

The transmission mechanism 7 has a movable section attachment 72 which rotatably supports the second pulley 631. The second pulley 631 is part of the movable section 61, that is, rotation of the first pulley 664 rotates the wire 71, thereby moving the movable section 61.

Figure 7:
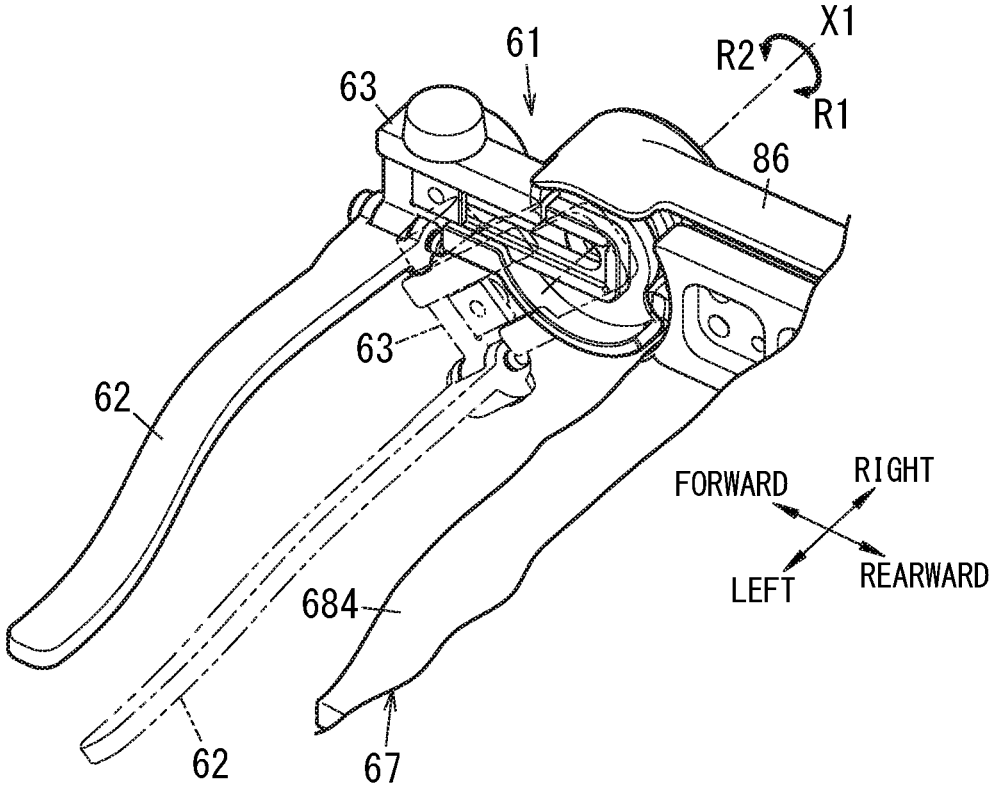
FIG. 7 is a perspective view of main part of the finger exerciser.

The movable section 61 is a portion that applies a mechanical stimulus to the fingers 53 (second to fifth fingers 531-534) of a subject 5 to move his or her fingers 53. The movable section 61 is configured to be movable in at least one direction by power transmitted via the wire 71. The movable section 61 is configured to be movable with respect to the frame 67 as illustrated in FIG. 7, and thereby, the fingers 53 (second to fifth fingers 531-534) can be moved with respect to the first finger 530 of the subject 5. The imaginary line in FIG. 7 indicates a state where the movable 61 has rotated from a first position. The movable section 61 includes an arm 63 and the finger rest 62 provided on the arm 63.

The arm 63 is a portion that is attached to a spindle 824 of the movable section attachment 72 and that rotates about the first axis X1. The first axis X1 extends in the left and right direction. The arm 63 is rotatable between the first position (position of the arm 63 indicated by a solid line in FIG. 7) and a second position (position of the arm 63 indicated by an imaginary line in FIG. 7). The first position is a position in which a longitudinal direction of the arm 63 is parallel to the forward and rearward direction. The second position is a position in which the longitudinal direction of the arm 63 forms a prescribed angle (e.g., 80°) with respect to the forward and rearward direction.

In the present disclosure, the rotation direction from the second position to the first position is referred to as a "first rotation direction R1", and the rotation direction from the first position to the second position is referred to as a "second rotation direction R2". Thus, in the present disclosure, "open operation" refers to operation of the finger rest 62 caused by rotation of the arm 63 in the first rotation direction R1, and "closed operation" refers to operation of the finger rest 62 caused by rotating the arm 63 in the second rotation direction R2.

The finger rest 62 is configured such that pads of the fingers 53 (second to fifth fingers 531-534) of a subject 5 are to be put on the finger rest 62. As used herein, the "pads of the fingers 53" refer to the anterior surfaces of the fingers 53 (see imaginary line in FIG. 4). That is, in the present disclosure, the "pads of the hand fingers 53" of the second to fifth fingers 531-534 includes not only the anterior surfaces of the finger tips but also anterior surfaces of the bases of the fingers.

The finger rest 62 has a forward edge of an intermediate portion in the left and right direction, and the forward edge is tilted rearward as it is closer to the tip end of the finger rest 62 in a state where the arm 63 is in the first position. Therefore, in a state where the fingers 53 (second to fifth fingers 531-534) of the subject 5 are placed on the finger rest 62, the forward edge of the finger rest 62 lies along the fingers 53.

When the finger exerciser 6 having such a configuration is worn by the subject 5 on his or her forearm and hand, the motor 66 (drive source 691) is located above the forearm, and the wire 71 (linear member 70) is located on a side of the arm in a state where the forearm of the subject 5 is horizontal and the palm faces downward. When the motor 66 is operated in this state, power is transmitted to the movable section 61 via the linear member 70, and the movable section 61 performs the open operation or closed operation. Thus, it is possible the support the subject 5 in the stretching action and the gripping action by the finger exerciser 6.

(2.2) Method of Wearing Finger Exerciser

Next, a method by which the finger exerciser is worn by the subject 5 on his or her left hand will be described in detail. Note that as described above, an aspect in which the outer surface cover of the finger exerciser 6 is omitted is explained in "(2.1) Finger Exerciser". However, in the following description, it is assumed that the outer surface cover is attached.

In the present embodiment, the finger exerciser 6 has an outer surface cover covering the frame 67 and the transmission mechanism 7. The outer surface cover is fixed to the frame 67 and the transmission mechanism 7. The outer surface cover is made of, for example, cloth, nylon, or the like. Note that the movable section 61 and the driver 69 are exposed from the outer surface cover.

Here, in the present disclosure, fixing an "object" to the frame 67 includes not only direct fixing to the frame 67 but also indirect fixing to the frame 67. That is, fixing an "object" to the frame 67 includes that the "object" is fixed to the frame 67 via the outer surface cover, and that the "object" is fixed to part of the outer surface cover covering the transmission mechanism 7.

The finger exerciser 6 makes the movable section 61 hold the second to fifth fingers 531-534 and makes the frame 67 hold the first finger 530 after the position of the first finger 530 is adjusted with respect to the frame 67. This enables an appropriate opposing position to be realized for a subject 5 who wears the finger exerciser 6. The finger exerciser 6 has the first fixing element 8 fixed to the movable section 61 and the second fixing element 9 fixed to the frame 67.

The first fixing element 8 performs positioning of a first finger group 54 of the subject 5 with respect to the movable section 61. That is, the first fixing element 8 fixes the relative position of the first finger group 54 to the movable 61. As used herein, "first finger group 54 of the subject 5" refers to at least one finger 53 included in the five fingers of the subject 5 and moved by the movable section 61. The first finger group 54 of the subject 5 may be a single finger or a plurality of fingers. In the present embodiment, the first finger group 54 of the subject 5 includes four fingers 53 (second to fifth fingers 531-534) except for the first finger 530. Note that if the first finger group 54 is, for example, only the second finger 531, the movable 61 moves only the second finger 531. As illustrated in FIG. 8, the first fixing element 8 includes the base section 81 and a band-like body 83.

The base section 81 is a portion for attaching the band-like body 83 to the movable section 61 (see FIG. 8). In the present embodiment, the base section 81 is fixed to the finger rest 62. The base section 81 has a plate shape extending along a longitudinal direction of the finger rest 62. Here, one end in a longitudinal direction of the base section 81 is defined as a first end 811 (corresponding to the left end of the finger rest 62 in the example shown in FIG. 7), and the other end in the longitudinal direction is defined as a second end (corresponding to the right end of the finger rest 62 in the example shown FIG. 7). Moreover, the base section 81 has elasticity and is made of, for example, nonwoven fabric, foamed urethane, resin foam of, for example, polyurethane, fabric rubber, or a rubber plate.

The base section 81 includes an insertion section 813 formed between both ends in the thickness direction of the base section 81 and an insertion opening 814 formed at a second end 812. The insertion opening 814 leads to the insertion section 813. When the base section 81 is attached to the finger rest 62, the tip end of the finger rest 62 is inserted through the insertion opening 814 into the insertion section 813. In this state, the base section 81 is fixed to the finger rest 62.

Note that the base section 81 is attached at least so as not to move with respect to the finger rest 62. For example, a connecting member such as a string or the like connected to the base section 81 may be wound around the arm 63 such that the base section 81 is attached so as not to move with respect to the finger rest 62. In order to facilitate attachment of the base section 81 to the finger rest 62, the inner dimension of the insertion section 813 of the base section 81 may be set to be slightly larger than the width of the finger rest 62. Thus, as used herein, "fixing the relative position of the first finger group 54 to the movable section 61" also includes an aspect in which the first fixing element 8 slightly moves relative to the movable 61 due to material characteristics, dimension tolerances, design error, or the like.

The base section 81 has a through component 82 fixed to the second end 812. The through component 82 is a member that holds the band-like body 83 by putting the band-like body 83 through the through component 82. The band-like body 83 fixed to the first end 811 has an intermediate portion in a longitudinal direction of the band-like body 83, and the intermediate portion is put through the through component 82, thereby allowing the fingers 53 to be inserted between the base section 81 and the band-like body 83.

The band-like body 83 is an elongated member and holds the first finger group 54 of the subject 5 between the band-like body 83 and the base section 81. The band-like body 83 overlaps the base section 81 in plan view. The band-like body 83 has one end in the longitudinal direction, and the one end is fixed to the first end 811 of the base section 81.

The band-like body 83 is configured to be stretchable in the longitudinal direction. In the present embodiment, the band-like body 83 has an elastic material such as rubber in part in the longitudinal direction and is thus stretchable in the longitudinal direction. Note that in the present disclosure, the band-like body 83 does not have to be stretchable. For example, the band-like body 83 may be a belt made of cloth, leather, or the like.

The band-like body 83 includes: a first band body 84 for holding two adjacent fingers of the first finger group 54; and a second band body 85 for holding the other two fingers. The first band body 84 includes a first portion 841 and a second portion 842. The first portion 841 has one end in a longitudinal direction of the first portion 841, and the one end is fixed to the first end 811 of the base section 81. The first portion 841 extends from the first end 811 of the base section 81 to the through component 82. The second portion 842 extends from an opposite end in the longitudinal direction of the first portion 841 from the base section 81. The second portion 842 is superimposed on part of the first portion 841. A part folded between the first portion 841 and the second portion 842 is put through the through component 82, and thereby, the first band body 84 is held by the base section 81.

Figure 9A:
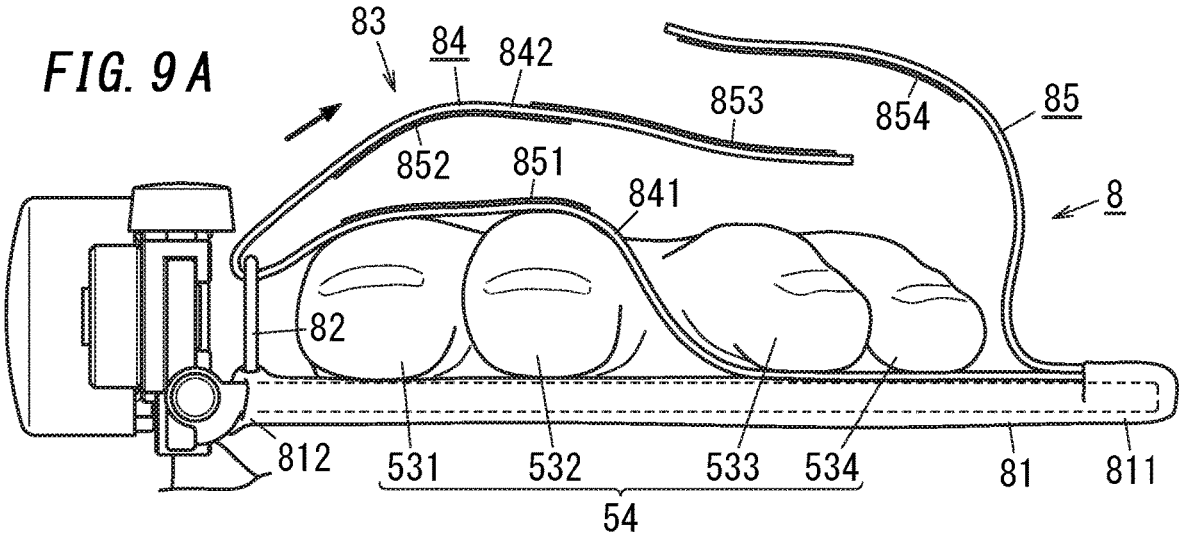
FIGS. 9A-9C are front views illustrating a method of attaching a first fixing element to a movable section in the finger exerciser.

The first portion 841 has an upper surface provided with a first connection section 851, and the second portion 842 has a lower surface provided with a second connection section 852 (see FIG. 9A). The first connection section 851 and the second connection section 852 are detachably connected to each other. The second connection section 852 is connectable to an arbitrary location of the first connection section 851.

Specifically, the first connection section 851 and the second connection section 852 constitute a hook-and-loop fastener. However, in the present disclosure, the first connection section 851 and the second connection section 852 are not limited to the hook-and-loop fastener and may include a plurality of snap buttons, a plurality of buttons, hooks, or the like provided at a plurality of locations in a longitudinal direction of the first band body 84. That is, in the present disclosure, saying that the second connection section 852 is connectable to an arbitrary location of the first connection section 851 includes a configuration in which a connection location can be altered stepwise.

The second band body 85 has one end in a longitudinal direction of the second band body 85, and the one end is fixed to the first end 811 of the base section 81. The second band body 85 extends from the first end 811 towards the second end 812. The second portion 842 of the first band body 84 has an upper surface in a longitudinal direction of the second portion 842, and the upper surface is provided with a third connection section 853. The second band body 85 has a lower surface provided with a fourth connection section 854 (see FIG. 9A). The third connection section 853 and the fourth connection section 854 are detachably connected to each other. Moreover, the fourth connection section 854 is connectable to an arbitrary location of the third connection section 853.

Specifically, the third connection section 853 and the fourth connection section 854 constitute a hook-and-loop fastener. However, in the present disclosure, the third connection section 853 and the fourth connection section 854 are not limited to the hook-and-loop fastener as in the case of the first connection section 851 and the second connection section 852. The third connection section 853 and the fourth connection section 854 may include a plurality of snap buttons, a plurality of buttons, hooks, or the like provided at a plurality of locations in the longitudinal direction of the second band body 85. That is, in the present disclosure, saying that the fourth connection section 854 is connectable to an arbitrary location of the third connection section 853 includes a configuration in which a connection location can be altered stepwise.

Figure 9B:
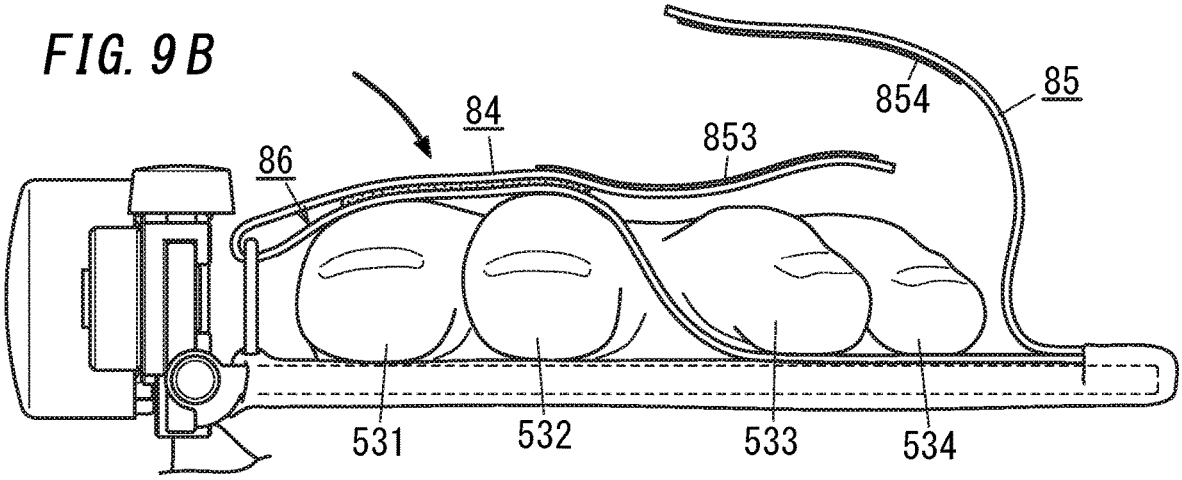
Figure 9C:
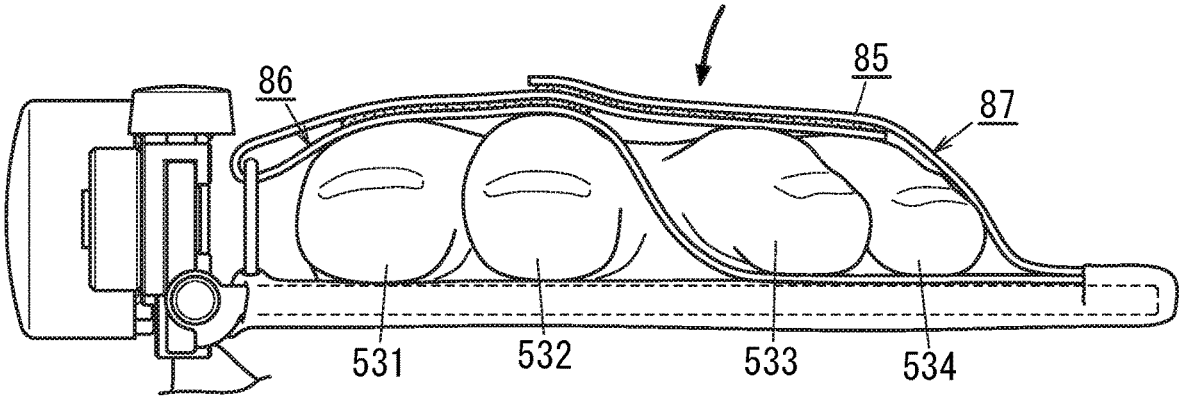

The first fixing element 8 having such a configuration is worn by a subject 5 on his or her fingers 53 as shown in FIGS. 9A-9C.

As shown in FIG. 9A, in a state where the second to fifth fingers 531-534 are placed on the base section 81, the first band body 84 is placed under the fifth finger 534 and the fourth finger 533, between the fourth finger 533 and the third finger 532, and above the third finger 532 and the second finger 531 in this order. In this state, the intermediate portion in the longitudinal direction of the first band body 84 is put through the through component 82. Then, an end of the first band body 84 facing away from the end fixed to the base section 81 is then folded back with the through component 82 being as a boundary, and as illustrated in FIG. 9B, the first connection section 851 and the second connection section 852 are connected to each other. In this way, the second finger 531 and the third finger 532 are held by the base section 81 and the first band body 84. That is, the base section 81 and the first band body 84 constitute a first holder 86 in the present disclosure. The first holder 86 holds two adjacent fingers 53 of the four fingers 53.

Then, as illustrated in FIG. 9C, the fourth connection section 854 of the second band body 85 is connected to the third connection section 853 of the second portion 842 placed on the fourth finger 533 and the fifth finger 534. As a result, the fourth finger 533 and the fifth finger 534 are held by the base section 81 and the second band body 85. That is, the base section 81 and the second band body 85 constitute a second holder 87 in the present disclosure. The second holder 87 holds fingers 53 other than the fingers 53 held by the first holder 86 of the four fingers 53.

The second connection section 852 is connectable to an arbitrary location in a longitudinal direction of the first connection section 851. Thus, while the first band body 84 is stretched, the first band body 84 is worn by a subject 5 on his or her second finger 531 and third finger 532. In this way, the strength of holding the second finger 531 and the third finger 532 by the first band body 84 is adjustable. Similarly, the fourth connection section 854 is connectable to an arbitrary location in a longitudinal direction of the third connection section 853. Thus, while the second band body 85 is stretched, the second band body 85 is worn by the subject 5 on his or her fourth finger 533 and fifth finger 534. In this way, the strength of holding the fourth finger 533 and the fifth finger 534 by the second band body 85 is adjustable.

The second fixing element 9 performs positioning of the second finger group 55 of the subject 5 with respect to the frame 67. That is, the second fixing element 9 fixes a relative position of the second finger group 55 of the subject 5 to the frame 67. As used herein, "second finger group 55 of the subject 5" refers to at least one finger of fingers other than the first finger group 54 of the fingers of the subject 5. The second finger group 55 of the subject 5 may be a single finger or a plurality of fingers. In the present embodiment, the second finger group 55 of the subject 5 is the first finger 530.

Figures 10A, 10B, 10C:
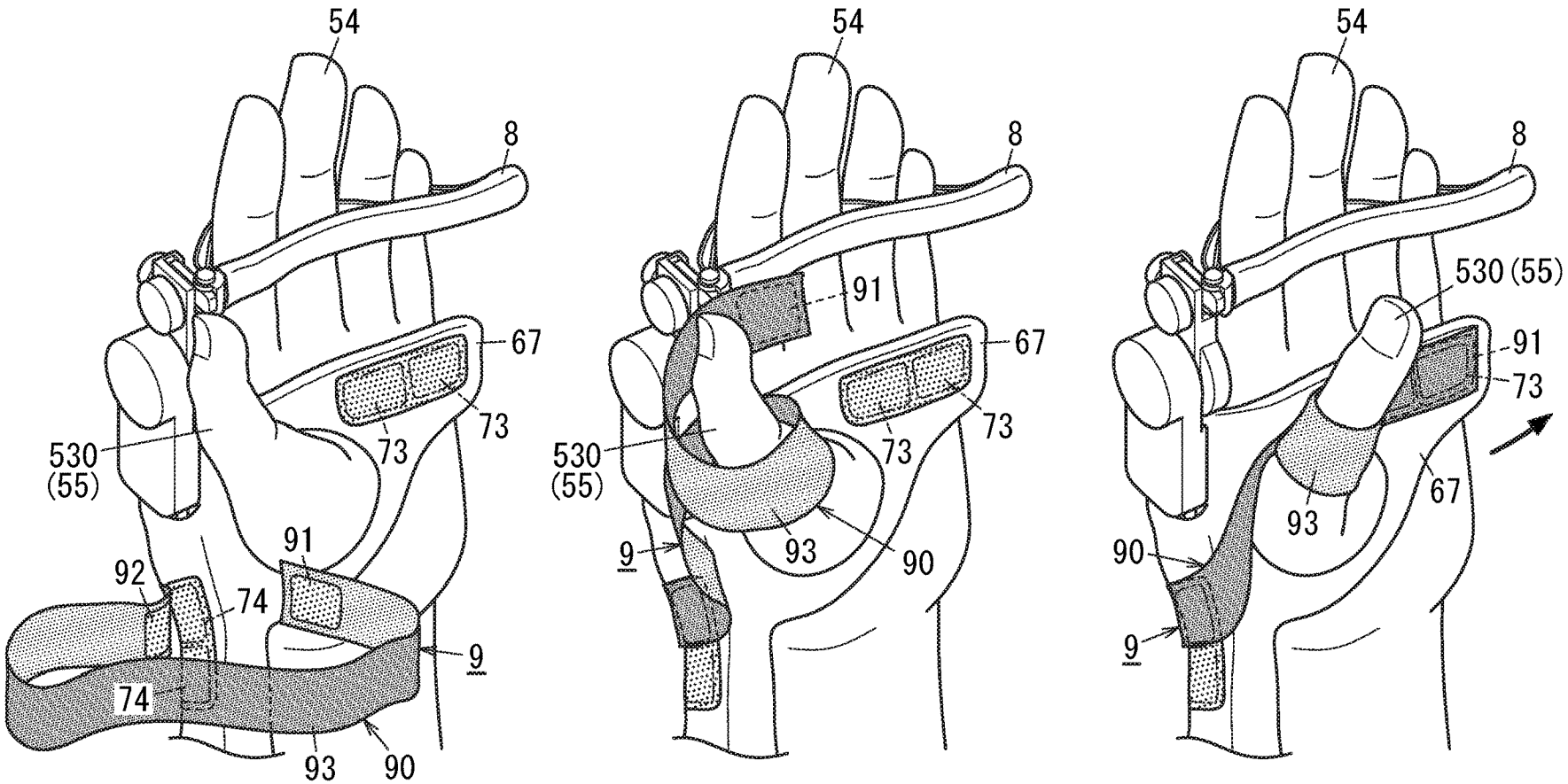
FIGS. 10A-10C are a perspective views illustrating a method of relatively fixing, for a subject whose first finger is abducted, the first finger to the frame by using a second fixing element in the finger exerciser.

As illustrated in FIG. 10A, the second fixing element 9 includes the band-like member 90. The band-like member 90 is made of a flexible material such as fabric and is stretchable in a longitudinal direction of the band-like member 90. In the present embodiment, the band-like member 90 is formed of, for example, rubber band or the like. However, in the present disclosure, the band-like member 90 is not limited to the rubber band but may be configured such that part of the band-like member 90 in the longitudinal direction has an elastic material such as rubber, and thereby, the band-like member 90 is stretchable in the longitudinal direction. Note that in the present disclosure, the band-like member 90 does not have to be stretchable. For example, the band-like member 90 may be a belt made of cloth, leather, or the like. The band-like member 90 has a plurality of attachment parts and a holder 93. The band-like member 90 is detachably attached to the frame 67 at the plurality of attachment parts.

In the present embodiment, the plurality of attachment parts are a first attachment part 91 and a second attachment part 92. The first attachment part 91 is detachably attached to first attachment-securing parts 73 of the frame 67 which will be described later. In the present embodiment, the first attachment part 91 is provided at an end in the longitudinal direction of the band-like member 90. The first attachment part 91 includes a hook-and-loop fastener attached to the end in the longitudinal direction of the band-like member 90.

Moreover, the frame 67 has a plurality of the first attachment-securing parts 73 to which the first attachment part 91 of the band-like member 90 is to be attached. Each of the first attachment-securing parts 73 is a portion to which the first attachment part 91 is to be attached. The plurality of first attachment-securing parts 73 are provided on a surface of the first projection 684 of the frame 67 to extend along the roots of the fifth finger 534, the fourth finger 533, and the third finger 532. In the present embodiment, the plurality of first attachment-securing parts 73 are connected to each other, and the boundary of the plurality of first attachment-securing parts 73 do not appear externally. The plurality of first attachment-securing parts 73 are formed as a single hook-and-loop fastener in the present embodiment. The first attachment part 91 of the band-like member 90 may be attached to a first attachment-securing part 73 accordingly selected from the plurality of first attachment-securing parts 73.

As used herein, "having first attachment-securing parts 73 at a plurality of locations" means that a plurality of first attachment-securing parts 73 may be a plurality of members or may be integrally formed. Moreover, the plurality of first attachment-securing parts 73 may be disposed to adjoin to each other or may be disposed with spaces therebetween.

The second attachment part 92 is detachably attached to second attachment-securing parts 74 of the frame 67. In the present embodiment, the second attachment part 92 is provided at an opposite end of the both ends in the longitudinal direction of the band-like member 90 from the first attachment part 91. In a similar manner to the first attachment part 91, the second attachment part 92 includes a hook-and-loop fastener attached to the opposite end in the longitudinal direction of the band-like member 90.

The frame 67 has the plurality of second attachment-securing parts 74 to which the second attachment part 92 is to be attached. Each of the second attachment-securing parts 74 is a portion to which the second attachment part 92 is to be attached. The plurality of second attachment-securing part 74 are aligned along the base 68 of the frame 67. In the present embodiment, the plurality of second attachment-securing parts 74 are connected to each other, and the boundaries between the plurality of second attachment-securing parts 74 do not appear externally. The plurality of second attachment-securing parts 74 are formed as a single hook-and-loop fastener in the present embodiment. The second attachment part 92 of the band-like member 90 may be attached to a second attachment-securing part 74 accordingly selected from the plurality of second attachment-securing parts 74.

As used herein, "having second attachment-securing parts 74 at a plurality of locations" means that a plurality of second attachment-securing parts 74 may be a plurality of members or may be integrally formed. Moreover, the plurality of second attachment-securing parts 74 may be disposed to adjoin to each other or may be disposed with spaces therebetween.

The holder 93 holds the second finger group 55 (first finger 530). In the present embodiment, the holder 93 is part of the band-like member 90 in the longitudinal direction and is formed between the first attachment part 91 and the second attachment part 92. The holder 93 is wrapped around the first finger 530 to hold the first finger 530 as shown in FIG. 10A-10C.

The relative position of the holder 93 to the frame 67 is changeable. That is, in the present embodiment, changing the attachment location of the band-like member 90 to the frame 67 in a state where the first finger 530 is held by the holder 93 enables the relative position of the holder 93 relative to the frame 67 to be changed. That is, the position of the first finger 530 held by the holder 93 can be adjusted. Specifically, the first attachment part 91 of the band-like member 90 can be attached to any of the plurality of first attachment-securing parts 73 to alter the relative position of the holder 93 to the frame 67. Moreover, the second attachment part 92 of the band-like member 90 can be attached to any of the plurality of second attachment-securing parts 74 to alter the relative position of the holder 93 to the frame 67.

Based on FIGS. 10A-10C, a method will be described in which the holder 93 is worn by a subject 5 on his or her first finger 530 which is abducted to achieve the opposing position for first finger 530. First, a medical staff, such as a physical therapist or an occupational therapist, attaches the second attachment part 92 of the band-like member 90 to any of the plurality of second attachment-securing parts 74. Then, the medical staff puts the band-like member 90 between the first finger 530 and the second finger 531 (see FIG. 10A) and wraps the band-like member 90 around the first finger 530, and thereafter, puts an end of the first attachment part 91 of band-like member 90 between the first finger 530 and the second finger 531 (see FIG. 10B). Then, the medical staff pulls the end, where the first attachment part 91 is provided, of the band-like member 90 to adjust the first finger 530 to the opposite position. Then, while this state is maintained, the first attachment part 91 is attached to any first attachment-securing part 73 of the plurality of first attachment-securing parts (see FIG. 10C).

Next, based on FIGS. 11A-11C, a methods will be described in which the holder 93 is worn by a subject 5 to his or her first finger 530 which is adducted to bring the first finger 530 into the opposing position. A medical staff attaches the first attachment part 91 of the band-like member 90 to any of the plurality of first attachment-securing parts 73.

Figures 11A, 11B, 11C:
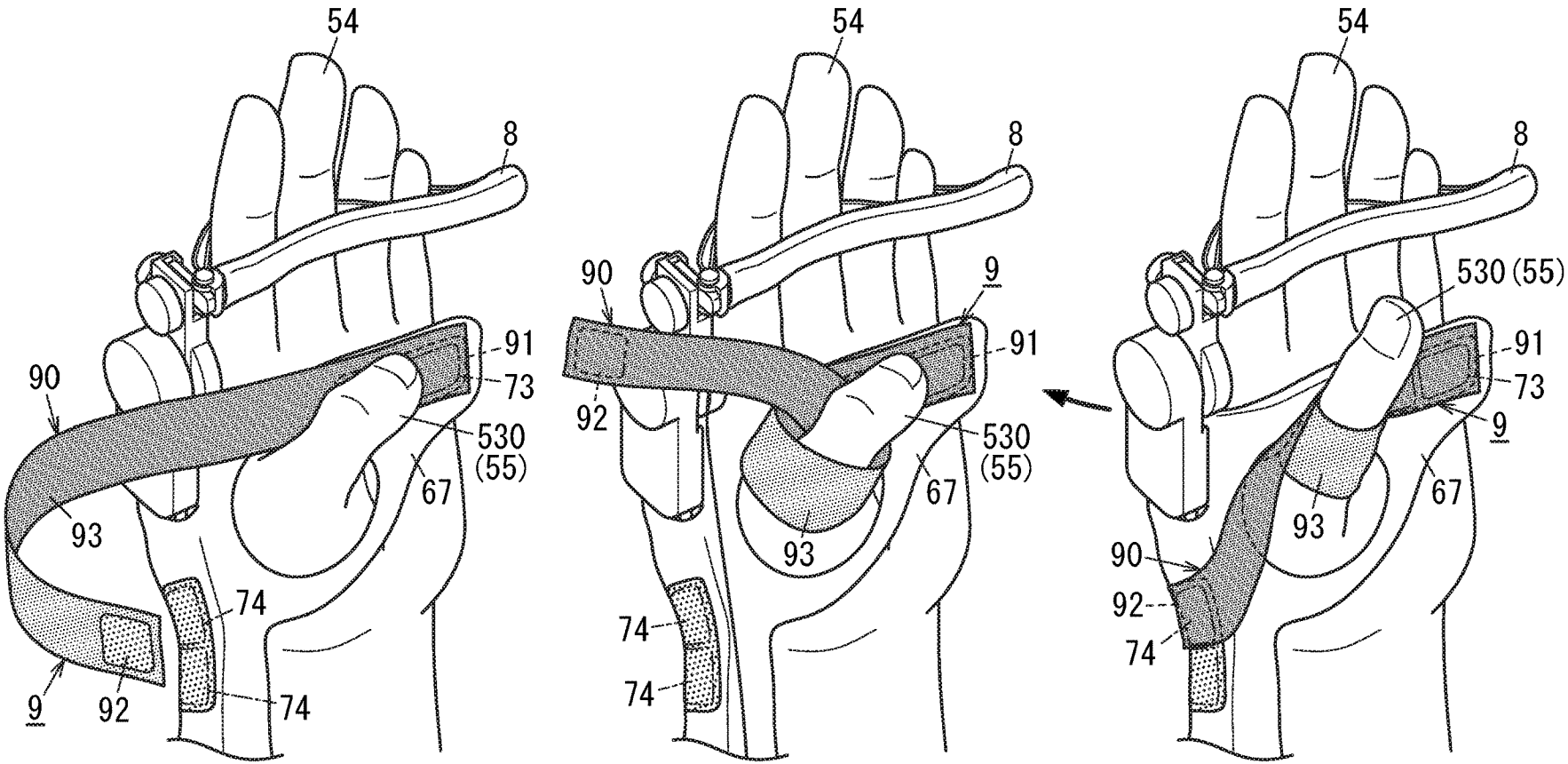
FIGS. 11A-11C are a perspective views illustrating a method of relatively fixing, for a subject whose first finger is adducted, the first finger to the frame by using the second fixing element in the finger exerciser.

Then, the medical staff puts the band-like member 90 between the first finger 530 and the second finger 531 (see FIG. 11A) and wraps the band-like member 90 around the first finger 530, and thereafter, puts an end of the second attachment part 92 of band-like member 90 between the first finger 530 and the second finger 531 (see FIG. 11B). Then, the medical staff pulls the end, where the second attachment part 92 is provided, of the band-like member 90 to achieve the opposite position for the first finger 530. Then, while this state is maintained, the second attachment part 92 is attached to any second attachment-securing part 74 of the plurality of second attachment-securing parts 74 (see FIG. 11C).

Thus, according to the finger exerciser 6 of the present embodiment, it is possible to assist the subject 5 in the voluntary movement such as the gripping action and the stretching action in state where the first finger group 54 and the second finger group 55 are brought into an appropriate positional relationship.

(2.3) Rehabilitation Support System

Next, the rehabilitation support system 100 according to this embodiment will be described in further detail.

As shown in FIG. 1, the rehabilitation support system 100 includes the electroencephalogram measurement system 10, the exercise assisting device 3 including the finger exerciser 6, and the controller 4.

In this embodiment, the electroencephalogram measurement system 10 includes the headset 1 and the information processor 2.

Figure 2:
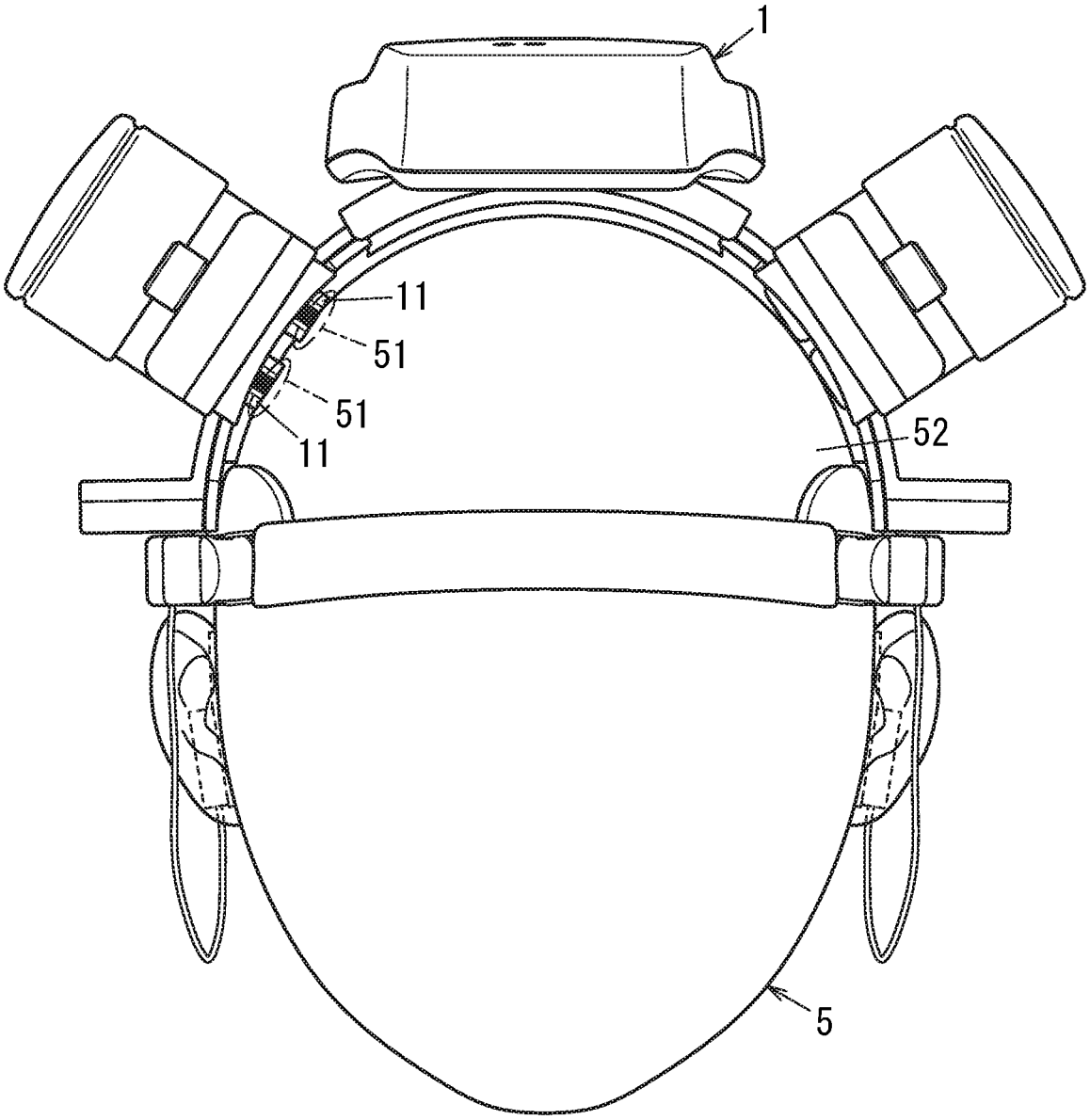
FIG. 2 is a schematic front view showing a usage state of a headset of the rehabilitation support system.
Figure 3:
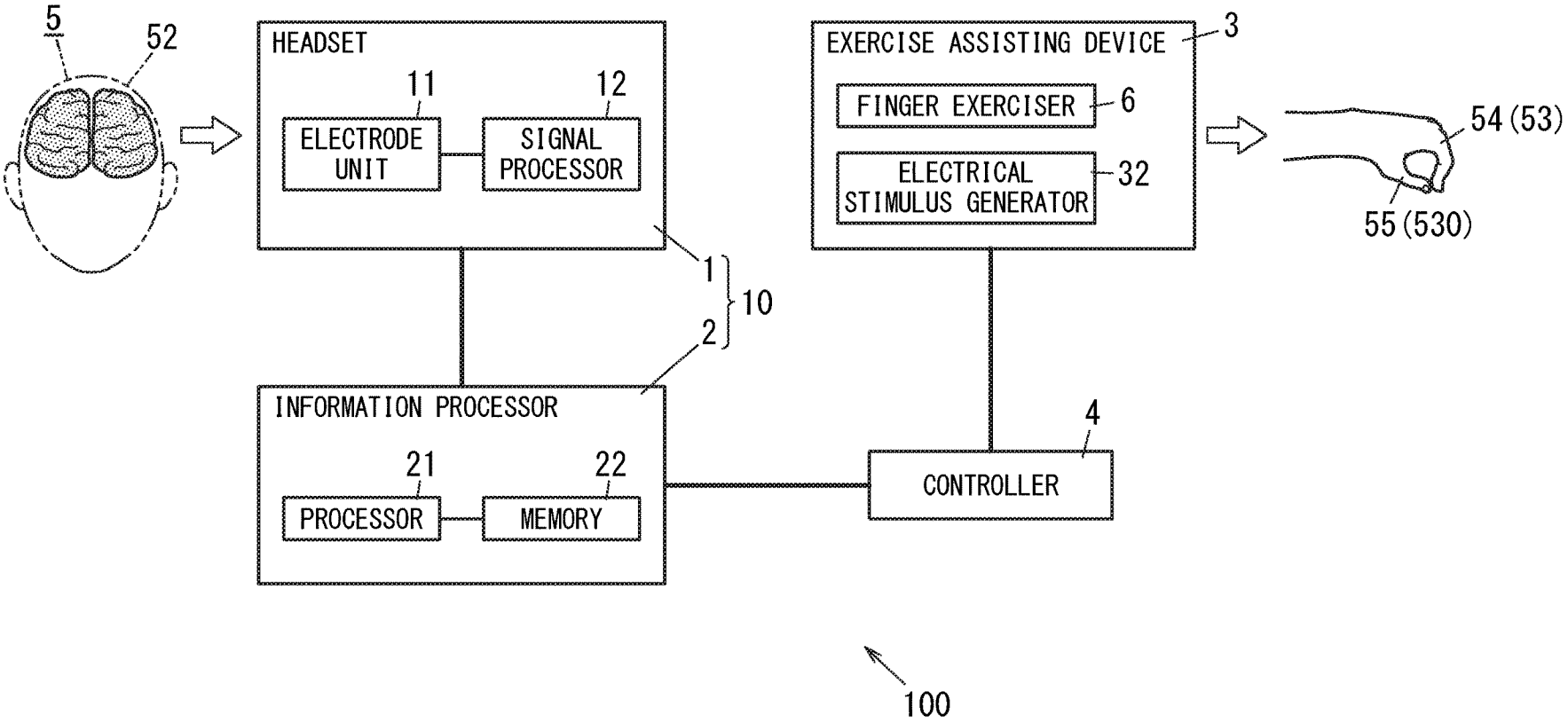
FIG. 3 is a block diagram indicating a configuration of the rehabilitation support system.

As shown in FIG. 2, the headset 1 is worn by the subject 5 on his or her head 52. The headset 1 includes the electrode unit 11. The electrode unit 11 is placed on a region of interest 51, which forms part of the subject's 5 head 52. Specifically, the headset 1 has the subject's 5 electroencephalogram measured by the electrode unit 11 that is brought into contact with the region of interest 51 defined on an area of the surface (scalp) of the subject's 5 head 52, thereby generating electroencephalogram information representing the electroencephalogram by a signal processor 12. The signal processor 12 performs signal processing on an electroencephalogram signal (electric signal) input from the electrode unit 11, and generates electroencephalogram information.

The information processor 2 includes, as its main constituent element, a computer system such as a personal computer. The computer system includes a processor 21 and memory 22 as hardware as main components. The information processor 2 receives the electroencephalogram information from the headset 1, for example, via wireless communication, and performs various types of processing on the electroencephalogram information. In this embodiment, detection of an electroencephalogram with a characteristic variation that arises when the subject 5 is going to do the voluntary movement (i.e., a characteristic variation that may arise when the subject 5 plans to do the voluntary movement), the calibration processing, and other types of processing are performed by the information processor 2.

When the subject 5 plans to do the voluntary movement, the electroencephalogram measured usually comes to have a characteristic variation that represents a brain wave produced in the motor area corresponding to a body region where the voluntary movement is conducted. Thus, the electroencephalogram measurement system 10 regards, as the target of measurement, the electroencephalogram detected from around the motor area corresponding to the affected region as the target of rehabilitation. In this case, the motor area corresponding to left hand fingers is located on the right side of the brain and the motor area corresponding to right hand fingers is located on the left side of the brain. That is why when the subject's 5 left hand fingers 53 are the target of rehabilitation as in this embodiment, the electroencephalogram obtained by the electrode unit 11 that is brought into contact with the right side of the subject's 5 head 52 is the target of measurement for this electroencephalogram measurement system 10. That is to say, the electrode unit 11 is placed on a region of interest 51 that forms part of the right surface of the subject's 5 head 52 as shown in FIG. 2. For example, the electrode unit 11 is placed at a location designated by the mark "C4" according to the international 10-20 system. On the other hand, when the subject's 5 right hand fingers are the target of rehabilitation, the electrode unit 11 is placed on a region of interest that forms part of the left surface of the subject's 5 head 52. For example, the electrode unit 11 may be placed at a location designated by the mark "C3" according to the international 10-20 system in that case.

On detecting an electroencephalogram with a characteristic variation that may arise when the subject 5 plans to do voluntary movement, the electroencephalogram measurement system 10 outputs a control signal for controlling the exercise assisting device 3. That is to say, in this rehabilitation support system 100, generation of a control signal for controlling the exercise assisting device 3 is triggered by detection by the electroencephalogram measurement system 10 of an electroencephalogram with a characteristic variation that may arise when the subject 5 plans to do voluntary movement. Thus, this rehabilitation support system 100 allows the exercise assisting device 3 to assist the subject 5 with his or her voluntary movement when the subject 5 is going to do the voluntary movement.

The exercise assisting device 3 is a device for assisting the subject 5 with his or her exercise by applying at least one of a mechanical stimulus or an electrical stimulus to the subject 5. In this embodiment, the rehabilitation support system 100 is used to support the subject 5 in his or her rehabilitation to recover the function of his or her left hand fingers, and therefore, the exercise assisting device 3 is worn by the subject 5 on his or her left hand as shown in FIG. 1.

Thus, the rehabilitation support system 100 according to this embodiment supports the subject 5, who is doing the stretching action as the voluntary movement, in his or her voluntary movement by making the exercise assisting device 3 worn by the subject 5 on his or her left hand apply at least one of a mechanical stimulus or an electrical stimulus to the subject's 5 left hand fingers 53. Specifically, the exercise assisting device 3 includes the finger exerciser 6 described above and an electrical stimulus generator 32 as shown in FIG. 3.

The electrical stimulus generator 32 is a device for applying an electrical stimulus to the subject's 5 region for moving his or her fingers 53. The electrical stimulus generator 32 can apply an electrical stimulus to the region to move the fingers 53. The subject's 5 region for moving his or her fingers 53 includes a region corresponding to at least one of a muscle or a nerve of the subject's 5 fingers 53. For example, the subject's 5 region for moving his or her fingers 53 may be a part of the subject's 5 right or left arm. The electrical stimulus generator 32 includes a pad to be attached to, for example, the subject's 5 body (such as his or her right or left arm). The electrical stimulus generator 32 may move the fingers 53 by applying an electrical stimulus (in the form of an electrical current) from the pad to the subject's 5 body.

The controller 4 controls the exercise assisting device 3 in accordance with the electroencephalogram information acquired by the electroencephalogram measurement system 10. In this embodiment, the controller 4 is electrically connected to the information processor 2 of the electroencephalogram measurement system 10 and the exercise assisting device 3. A power cable for supplying operating power to the exercise assisting device 3 and the controller 4 is connected to the controller 4. The controller 4 includes a driver circuit for driving the finger exerciser 6 of the exercise assisting device 3 and an oscillator circuit for driving the electrical stimulus generator 32. The controller 4 receives a control signal from the information processor 2 via wired communication, for example.

On receiving a first control signal from the information processor 2, the controller 4 makes its driver circuit drive the finger exerciser 6 of the exercise assisting device 3, thereby controlling the exercise assisting device 3 such that the finger exerciser 6 performs the "opening operation". Also, on receiving a second control signal from the information processor 2, the controller 4 makes its driver circuit drive the finger exerciser 6 of the exercise assisting device 3, thereby controlling the exercise assisting device 3 such that the finger exerciser 6 performs the "closing operation". Furthermore, on receiving a third control signal from the information processor 2, the controller 4 makes its oscillator circuit drive the electrical stimulus generator 32 of the exercise assisting device 3, thereby controlling the exercise assisting device 3 such that an electrical stimulus is applied to the subject's 5 body.

This allows the controller 4 to control the exercise assisting device 3 based on the electroencephalogram information acquired by the electroencephalogram measurement system 10 by controlling the exercise assisting device 3 in accordance with the control signals supplied from the electroencephalogram measurement system 10.

Next, it will be described how to use this rehabilitation support system 100. In the following description of this embodiment, it will be described how the rehabilitation support system 100 supports the subject 5 in his or her voluntary movement (i.e., the stretching action) to be done by the subject 5 in order to release a peg 101 (see FIG. 1) from his or her left hand by stretching the fingers 53 from a position where he or she is gripping the peg 101 with his or her left hand fingers.

First, as a preparation process, the subject 5 wears the headset 1 on the head 52 and also wears the exercise assisting device 3 on his or her left hand. In this case, the subject 5 wears the headset 1 on his or her head 52 such that at least the electrode unit 11 is brought into contact with a part of the right surface of the subject's 5 head 52, which constitutes the region of interest 51. The exercise assisting device 3 is worn by the subject 5 so as to hold at least the four fingers 53 (i.e., the second to fifth fingers 531-534), except the first finger (thumb), of the subject's 5 left hand and attach the pad to the subject's 5 left arm. The headset 1 and the exercise assisting device 3 may be firmly fixed as appropriate so as not to be displaced or come loose during the rehabilitation. In the preparation process, the subject's 5 four fingers 53 are held by the finger exerciser 6 of the exercise assisting device 3 to make the subject 5 keep gripping the peg 101 with his or her left hand fingers. The subject 5 may be equipped with the headset 1 and the exercise assisting device 3 by either the subject 5 him- or herself or a medical staff.

When the preparation is done to make the headset 1 and the information processor 2 ready to communicate with each other, the electroencephalogram information generated by the headset 1 may be acquired by the information processor 2. That is to say, the electroencephalogram measurement system 10 may acquire, at the information processor 2, the electroencephalogram information representing an electroencephalogram obtained by the electrode unit 11 placed on the region of interest 51 that forms part of the subject's 5 head 52. The information processor 2 makes its memory 22 (see FIG. 3) store (accumulate), along the time axis, the electroencephalogram information acquired. In addition, the information processor 2 generates a power spectrum of the electroencephalogram by carrying out a time frequency analysis on the electroencephalogram information stored, for example. This allows the electroencephalogram measurement system 10 to detect an electroencephalogram with a characteristic variation that may arise when the subject 5 plans to do voluntary movement by making the information processor 2 constantly monitor the data of the power spectrum.

In this case, before the subject 5 starts his or her rehabilitation, the electroencephalogram measurement system 10 performs calibration processing for determining various types of parameters for use to detect an electroencephalogram as the target of detection. This allows the electroencephalogram measurement system 10 to improve the accuracy of detecting the electroencephalogram as the target of detection with variations from one subject 5 to another, in, for example, the frequency band where the power declines due to the event-related desynchronization and the magnitude of the decline in power, taken into account.

As used herein, the "event-related desynchronization" refers to a decline in power falling within a particular frequency band of the electroencephalogram representing a brain wave measured in the vicinity of a motor area during the voluntary movement (or when the subject 5 just imagines doing the voluntary movement). As used herein, the phrase "during the voluntary movement" refers to a process that begins when the subject 5 plans to do (or imagines doing) the voluntary movement and ends when the voluntary movement is either done successfully or ends up in failure. The "event-related desynchronization" may be triggered, during the voluntary movement, by the subject's plan to do the voluntary movement (or his or her image of doing the voluntary movement). The frequency bands in which the event-related desynchronization causes a decline in power are mainly an $\alpha$ wave range (such as a frequency band from 8 Hz to less than 13 Hz) and a $\beta$ wave range (such as a frequency band from 13 Hz to less than 30 Hz).

After having finished the preparation process including the calibration processing, the rehabilitation support system 100 starts performing a training process for supporting the subject 5 in his or her rehabilitation. In the training process, the subject 5 is supported in his or her rehabilitation based on the electroencephalogram measured by the electroencephalogram measurement system 10 during a training period. Specifically, the training period is subdivided into two periods, namely, a rest period and an exercise period. In each of the rest period and the exercise period, the subject 5 undergoes his or her rehabilitation in accordance with the instructions given by the rehabilitation support system 100.

In the rest period, the subject 5 puts his or her body at rest (i.e., does not plan to do (or imagine doing) any voluntary movement) to keep relaxed. At this time, the electroencephalogram measurement system 10 does not detect any electroencephalogram with a characteristic variation that may arise due to the event-related desynchronization when the subject 5 plans to do the voluntary movement.

Meanwhile, in the exercise period, the subject 5 plans to do (or imagines doing) the action of stretching the fingers 53 as a type of voluntary movement. At this time, the electroencephalogram measurement system 10 may detect an electroencephalogram with a characteristic variation that may arise due to the event-related desynchronization when the subject 5 plans to do the voluntary movement. In this embodiment, such a characteristic variation in electroencephalogram is detected by comparing an activation level with a threshold value and determining whether or not the activation level is greater than the threshold value. As used herein, the "activation level" refers to a value representing the magnitude of decline in power (i.e., power spectrum) in a particular frequency band. When the event-related desynchronization causes a decline in the power in the particular frequency band, the activation level exceeds the threshold value. Thus, the electroencephalogram measurement system 10 detects the characteristic variation in electroencephalogram when finding the activation level greater than the threshold value.

In this electroencephalogram measurement system 10, generation of a control signal for controlling the exercise assisting device 3 is triggered by the detection of the electroencephalogram with such a characteristic variation. This allows, when the subject 5 plans to do voluntary movement, the rehabilitation support system 100 to make the exercise assisting device 3 assist the subject 5 with the voluntary movement at the timing when a brain region, corresponding to the target region of the voluntary movement, is actually activated.

Variations

The first embodiment is one of the various embodiments of the present disclosure. Various modifications may be made to the first embodiment depending on design and the like as long as the object of the present disclosure is achieved. Variations of the first embodiment will be described below. Note that any of the variations to be described below may be combined as appropriate.

Figure 12A:
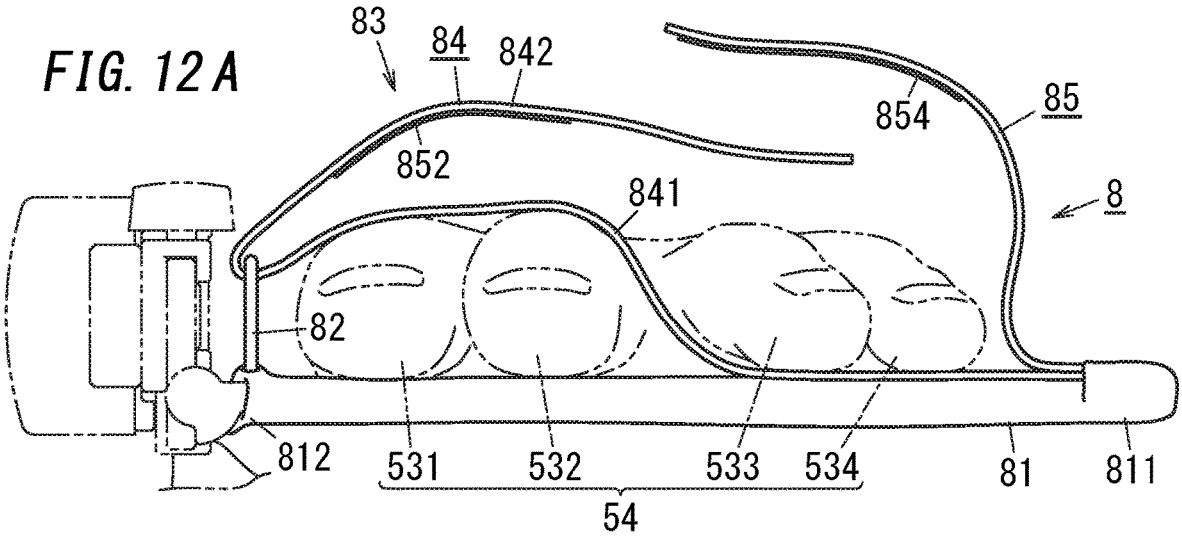
FIG. 12A is a front view of a first fixing element according to a first variation.

The first fixing element 8 of the first embodiment may be configured as shown in, for example, FIG. 12A. This configuration is defined as a first variation. In the first fixing element 8 according to the first embodiment, as shown in FIG. 9A, the first band body 84 includes the first connection section 851 provided on the upper surface of the first portion 841 and the second connection section 852 provided on a lower surface of the second portion 842, and the first connection section 851 and the second connection section 852 are connectable to each other. In contrast, in a first fixing element 8 according to the first variation, as shown in FIG. 12A, a first connection section 851 is not provided on an upper surface of a first portion 841, and a first band body 84 is made of a material connectable to a second connection section 852. In sum, the first portion 841 has a function which enables connection to the second connection section 852.

Moreover, in the first fixing element 8 according to the first embodiment, as shown in FIG. 9A, the third connection section 853 is provided on the upper surface of the second portion 842 of the first band body 84, the fourth connection section 854 is provided on the lower surface of the second band body 85, and the third connection section 853 and the fourth connection section 854 are connectable to each other. In contrast, in the first fixing element 8 according to the first variation, as shown in FIG. 12A, a third connection section 853 is not provided on an upper surface of the second portion 842, and the first band body 84 is made of a material connectable to a fourth connection section 854. In sum, the second portion 842 has a function which enables connection to the fourth connection section 854.

As a material that can be connected to the connection sections 852 and 854, for example, when the connection sections 852 and 854 are hook-and-loop fasteners, the hook-and-loop fasteners themselves each having a band-like shape may be the first band body 84, or the first band body 84 may be formed of cloth with raised fibers on its surface.

Figure 12B:
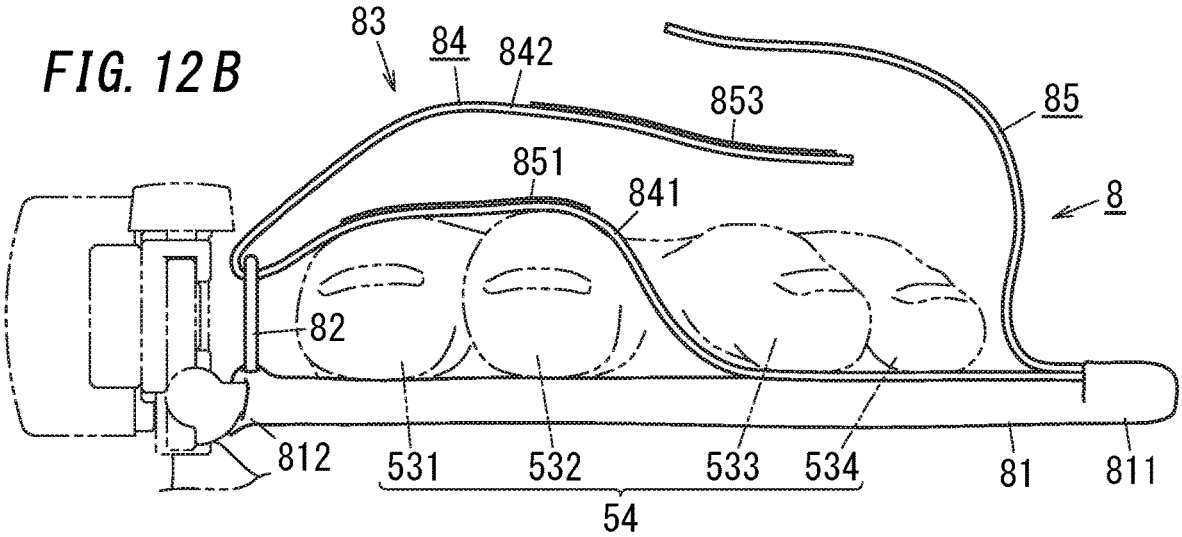
FIG. 12B is a front view of a first fixing element according to a second variation.

Moreover, in a second variation, as illustrated in FIG. 12B, a material similar to the material in the first variation may be adopted as a material for a first band body 84, a first portion 841 may be provided with a first connection section 851, and the second connection section 852 may be omitted. Moreover, the first band body 84 may be provided with a third connection section 853, and a second band body 85 having a function of a fourth connection section 854 may be used to omit the fourth connection section 854.

Thus, the first fixing element 8 of the first and second variations provides the advantage that at least two connection sections of the first connection section 851, the second connection section 852, the third connection section 853, and the fourth connection section 854 can be omitted, and the number of members can be reduced.

The first attachment part 91, the second attachment part 92, the first attachment-securing part 73, and the second attachment-securing part 74 of the first embodiment are hook-and-loop fasteners but are not limited to the hook-and-loop fasteners in the present embodiment. The first attachment part 91, the second attachment part 92, the first attachment-securing part 73, and the second attachment-securing part 74 may be, for example, snap buttons, buttons, hooks, wire fasteners, key hooks, buckles, or the like. Moreover, the first attachment part 91 and the second attachment part 92 may be a plurality of holes formed in the band-like member 90. In this case, the first attachment-securing part 73 and the second attachment-securing part 74 are preferably buttons. Forming the plurality of holes at regular pitches along the longitudinal direction of the band-like member 90 enables the attachment location to be changed stepwise.

The first attachment part 91 and the second attachment part 92 of the band-like member 90 are configured to be detachable from the frame 67. However, for example, in the present disclosure, one of the first attachment part 91 and the second attachment part 92 may be non-detachably attached to the frame 67. In this case, for example, one end of the band-like member 90 is sewn onto or attached via an adhesive to the frame 67.

Moreover, the holder 93 according to the first embodiment holds the second finger group 55 by the holder 93 wrapped around the second finger group 55. However, the holder 93 of the present disclosure is not limited to the configuration in which the holder 93 is wrapped around the second finger group 55. For example, a ring-shaped body for holding the second finger group 55 may be attached to a belt via a connector, such as buckle, to allow the ring-shaped body to move relative to the belt.

The band-like member 90 according to the first embodiment is attached to the frame 67 at the first attachment part 91 and the second attachment part 92. However, in the present disclosure, the band-like member 90 may be attached to the frame 67 at three or more attachment parts in the present disclosure.

The electroencephalogram measurement system 10 according to the present disclosure includes a computer system. In that case, the computer system may include, as principal hardware components, a processor and a memory. The functions of the electroencephalogram measurement system 10 according to the present disclosure may be performed by making the processor execute a program stored in the memory of the computer system. The program may be stored in advance in the memory of the computer system. Alternatively, the program may also be downloaded through a telecommunications network or be distributed after having been recorded in some non-transitory storage medium such as a memory card, an optical disc, or a hard disk drive, any of which is readable for the computer system. The processor of the computer system may be made up of a single or a plurality of electronic circuits including a semiconductor integrated circuit (IC) or a largescale integrated circuit (LSI). Those electronic circuits may be either integrated together on a single chip or distributed on multiple chips, whichever is appropriate. Those multiple chips may be integrated together in a single device or distributed in multiple devices without limitation.

Also, the electrode unit 11 does not have to be configured to come into contact with the surface (i.e., the scalp) of the subject's 5 head 52. Alternatively, the electrode unit 11 may also be configured to come into contact with the surface of the brain, for example.

Furthermore, the method of communication between the headset 1 and the information processor 2 is supposed to be wireless communication in the first embodiment described above, but may also be wired communication or communications via a relay, for example.

Furthermore, the method of communication between the controller 4 and the information processor 2 is supposed to be wired communication in the first embodiment but may also be wireless communication or communication via a relay, for example.

Furthermore, the headset 1 does not have to be driven by a battery but the power to operate the signal processing unit 12, the first communications unit, and other components may also be supplied from the information processor 2, for example.

Furthermore, the information processor 2 does not have to be configured to acquire electroencephalogram information from the dedicated headset 1. Alternatively, the information processor 2 may also be configured to acquire electroencephalogram information from a general-purpose electroencephalograph, for example.

The finger exerciser 6 according to the first embodiment is used for a rehabilitation support system, but is not limited to this example. The finger exerciser 6 may be used for general rehabilitation.

Summary

As described above, a finger exerciser (6) of a first aspect includes: a frame (67); a movable section (61); a first fixing element (8); and a second fixing element (9). On the frame (67), a palm of a subject (5) is to be put. The movable section (61) is movable relative to the frame (67) by power from a drive source (691) and is configured to move a first finger group (54) including at least one finger of the subject (5). The first fixing element (8) is configured to fix a relative position of the first finger group (54) to the movable section (61). The second fixing element (9) is configured to fix a relative position of a second finger group (55) to the frame (67). The second finger group (55) includes at least one finger of fingers different form the first finger group (54). The second fixing element (9) includes a band-like member (90) having at least two attachment parts (91, 92) apart from each other in a longitudinal direction of the band-like member (90). The band-like member (90) is configured to be attached to the frame (67) at the at least two attachment parts (91, 92). The band-like member (90) includes a holder (93) whose relative position to the frame (67) is changeable. The band-like member (90) is configured to hold the second finger group (55) by the holder (93) in a state where the band-like member (90) is attached to the frame (67).

This aspect enables the relative position of the second finger group (55) to the frame (67) to be changed, and therefore, it is possible to bring the second finger group (55) into an appropriate positional relationship with respect to the first finger group (54).

In a finger exerciser (6) of a second aspect referring to the first aspect, the frame (67) has attachment-securing parts (73, 74) at a plurality of locations, at least one attachment part (91, 92) of the at least two attachment parts being attachable to any one of the attachment-securing parts (73, 74).

This aspect enables the location of the holder (93) to be changed by selecting one attachment-securing part of the plurality of attachment-securing parts of the frame (67) and attaching the band-like member (90) to the one attachment-securing part. That is, this aspect enables a relatively simple configuration to realize a configuration in which the relative position of the holder (93) to the frame (67) is changeable.

In a finger exerciser (6) of a third aspect referring to the first or second aspect, the holder (93) is part of the band-like member (90) in the longitudinal direction and is configured to be wrapped around the second finger group (55) to hold the second finger group (55).

This aspect enables the band-like member (90) to hold the second finger group (55) without a structure for holding the second finger group (55) being added to the band-like member (90).

In a finger exerciser (6) of a fourth aspect referring to any one of the first to third aspects, the band-like member (90) includes a first attachment part (91) and a second attachment part (92) as the at least two attachment parts. The frame (67) has first attachment-securing parts (73) at a plurality of locations, the first attachment part (91) being attachable to any one of the first attachment-securing parts (73). The frame (67) also has second attachment-securing parts (74) at a plurality of locations, the second attachment part (92) being attachable to any one of the second attachment-securing parts (74).

This aspect enables a relative position of the holder (93) to the frame (67) to be more easily changed.

In a finger exerciser (6) of a fifth aspect referring to any one of the first to fourth aspects, the first finger group (54) includes four fingers 53 which are an index finger (531), a middle finger (532), a ring finger (533) and a pinky finger (534). The first fixing element (8) is configured to fix a relative position of the four fingers (53) to the movable section (61).

This aspect enables the four fingers (53) to be collectively fixed to the movable section (61).

In a finger exerciser (6) of a sixth aspect referring to the fifth aspect, the first fixing element (8) includes a first holder (86) and a second holder (87). The first holder (86) is configured to hold two adjacent fingers of the four fingers (53). The second holder (87) is configured to hold two fingers other than the two adjacent fingers of the four fingers (53).

With this configuration, fixing the four fingers (53) for each two fingers enables the first fixing element (8) to be easily worn by the subject (5) on the fingers (53).

In a finger exerciser (6) of a seventh aspect referring to any one of the first to sixth aspects, the first fixing element (8) includes: a base section (81) configured to be fixed to the movable section (61); and a band-like body (83). The band-like body (83) is configured to be attached to the base section (81) and hold the first finger group (54) between the band-like body (83) and the base section (81).

This aspect enables a simple configuration to realize the configuration in which the first finger group (54) is fixed to the movable section (61).

A rehabilitation support system (100) of an eighth aspect includes the finger exerciser (6) of any one of the first to seventh aspects, an electrode unit (11), and a controller (4). The electrode unit (11) is disposed in a region of interest (51) serving as part of the head (52) of a subject (5) and is configured to obtain an electroencephalogram of the subject (5). The controller (4) is configured to control the finger exerciser (6) in accordance with the electroencephalogram obtained by the electrode unit (11).

This aspect enables rehabilitation by movement therapy to be performed similarly to the case where medical staff such as a physical therapist or an occupational therapist holds the fingers (53) of a subject (5) to support the subject (5) in his or her movement of the fingers (53).

The configurations of the second to seventh aspects are not essential configurations of the finger exerciser (6) and may be omitted accordingly.

REFERENCE SIGNS LIST

5 SUBJECT
53 FINGERS
531 SECOND FINGER
532 THIRD FINGER
533 FOURTH FINGER
534 FIFTH FINGER
54 FIRST FINGER GROUP
55 SECOND FINGER GROUP
6 FINGER EXERCISER
61 MOVABLE DEPARTMENT
67 FRAME
73 FIRST ATTACHMENT-SECURING PART (ATTACHMENT-SECURING PART)
74 SECOND ATTACHMENT-SECURING PART (ATTACHMENT-SECURING PART)
691 DRIVE SOURCE
8 FIRST FIXING ELEMENT
81 BASE SECTION
83 BAND-LIKE BODY
86 FIRST HOLDER
87 SECOND HOLDER
9 SECOND FIXING ELEMENT
90 BAND-LIKE MEMBER
91 FIRST ATTACHMENT PART (ATTACHMENT PART)
92 SECOND ATTACHMENT PART (ATTACHMENT PART)
93 HOLDER

The invention claimed is:

1. A finger exerciser, comprising:

a frame on which a palm of a subject is to be put;

a movable section movable relative to the frame by power from a drive source, the movable section being configured to move a first finger group including at least one hand finger of the subject;

a first fixing element configured to fix a relative position of the first finger group to the movable section; and a second fixing element configured to fix a relative position of a second finger group to the frame, the second finger group including at least one hand finger of hand fingers different form the first finger group, the second finger group being a thumb, the second fixing element including a band-like member having at least two attachment parts apart from each other in a longitudinal direction of the band-like member, the band-like member being configured to be attached to the frame at the at least two attachment parts, the band-like member including a first attachment part and a second attachment part as the at least two attachment parts, the frame having:

first attachment-securing parts at a plurality of locations, the first attachment part being attachable to any one of the first attachment-securing parts; and second attachment-securing parts at a plurality of locations, the second attachment part being attachable to any one of the second attachment-securing parts, the band-like member including a holder whose relative position to the frame is changeable, the band-like member being configured to hold the second finger group by the holder in a state where the band-like member is attached to the frame;

the second fixing element being configured to fix the relative position of the second finger group to the frame in a state where the first finger group and the second finger group are brought into an opposite position, the opposite position being an appropriate positional relationship of the second finger group to the first finger group fixed the first fixing element for gripping an object.

2. The finger exerciser of claim 1, wherein the holder is part of the band-like member in the longitudinal direction and is configured to be wrapped around the second finger group to hold the second finger group.

3. The finger exerciser of claim 1, wherein the first finger group includes four hand fingers which are an index finger, a middle finger, a ring finger, and a pinky finger, and the first fixing element is configured to fix a relative position of the four hand fingers to the movable section.

4. The finger exerciser of claim 3, wherein the first fixing element includes a first holder configured to hold two adjacent hand fingers of the four hand fingers and a second holder configured to hold two hand fingers other than the two adjacent hand fingers of the four hand fingers.

5. The finger exerciser of claim 1, wherein the first fixing element includes a base section configured to be fixed to the movable section, and a band-like body configured to be attached to the base section and hold the first finger group between the band-like body and the base section.

* * * * *